US006893531B1

(12) United States Patent
Todaro et al.

(10) Patent No.: US 6,893,531 B1
(45) Date of Patent: May 17, 2005

(54) SLITTER-SPLICER FOR JOINING THE ENDS OF SHEETS

(75) Inventors: Frank A Todaro, Old Saybrook, CT (US); David J. Clark, Old Saybrook, CT (US); Brian C. Richardson, Bozrah, CT (US)

(73) Assignee: Asterisk, Inc, Old Saybrook, CT (US)

( * ) Notice: Subject to any disclaimer, the term of this patent is extended or adjusted under 35 U.S.C. 154(b) by 509 days.

(21) Appl. No.: 10/016,155

(22) Filed: Dec. 10, 2001

Related U.S. Application Data

(63) Continuation-in-part of application No. 09/187,376, filed on Nov. 6, 1998, now Pat. No. 6,331,222.
(60) Provisional application No. 60/271,917, filed on Feb. 27, 2001.

(51) Int. Cl.[7] ..... B65H 21/00
(52) U.S. Cl. ..... 156/304.3; 156/304.1; 156/502; 156/505
(58) Field of Search ..... 156/304.1, 304.3, 156/304.5, 502, 504, 505, 506

(56) References Cited

U.S. PATENT DOCUMENTS

| | | | | |
|---|---|---|---|---|
| 2,577,570 A | * | 12/1951 | Eisenberg | 156/202 |
| 3,318,754 A | * | 5/1967 | Philippi | 156/505 |
| 3,642,555 A | * | 2/1972 | Nagoshi et al. | 156/505 |
| 3,709,759 A | * | 1/1973 | Hyca | 156/506 |
| 3,717,535 A | * | 2/1973 | Jorgensen | 156/443 |
| 3,957,567 A | * | 5/1976 | Pursell et al. | 156/505 |
| 4,101,357 A | * | 7/1978 | Rothrock | 156/159 |
| 4,179,960 A | * | 12/1979 | Hanke | 83/175 |
| 4,564,184 A | * | 1/1986 | Rumpel | 270/39.01 |
| 5,354,408 A | * | 10/1994 | Otomine et al. | 156/505 |
| 5,779,851 A | | 7/1998 | Ifkovits et al. | 156/505 |

OTHER PUBLICATIONS

The Laserfeed Company "How to Use the Laserfeed Splice Rite®", unknown date, Instruction Sheet, One Page.
Laserline Corporation "LC4000 Splice Cart Unit (SCU)", unknown date, Catalog Sheet, One Page.
Energy Saving Products Co. "The Laserfeed Company Document Processing Solutions", unknown date, Catalog Sheet, One Page.

* cited by examiner

*Primary Examiner*—Mark A. Osele
(74) *Attorney, Agent, or Firm*—C. Nessler

(57) ABSTRACT

A splicer quickly and accurately joins together with tape the ends of plain sheets or perforated sheets, such as the ends of fanfold sheet commonly used for printing. The sheets are clamped between mating pairs of resilient strips by a top which hinges down onto a base. The base has a combination of frictional clamps and retractable pins, for aligning the ends of sheet before they are clamped in place by the top, according to whether the sheets are perforated or not. A head is then moved rearwardly along the top, to first slit overlapping sheets and create a precise butt line, when that is required. An anti-friction surface on one of the resilient clamping strips attached to the top enables selective removal a one trim piece, to expose the butt line for taping, without release of the clamping action on the sheets. The head is then moved forward to precisely apply tape from a dispenser, and to automatically cut the tape and the end of the run. A cam, cam follower, and several interacting mechanical subassemblies carry out the required complex motions.

8 Claims, 22 Drawing Sheets

SLITTER-SPLICER FOR JOINING THE ENDS OF SHEETS

This application is a continuation-in-part of patent application Ser. No. 09/187,376, filed Nov. 6, 1998, now U.S. Pat. No. 6,331,222. This application claims benefit of provisional patent application Ser. No. 60/271,917, filed Feb. 27, 2001.

TECHNICAL FIELD

The present invention relates to devices for slitting and joining together thin sheets of material, such as sheets of paper, particularly in connection with use of sheet in the printing field.

BACKGROUND

In feeding paper and other sheet materials to printers and other kinds of finishing machines, it is often a desire that the feeding of sheet material be continuous. Thus, when the sheet material is supplied in batches, a first batch must be connected to the second batch upstream of the processing machine. While such a need is present when handling rolls of sheet material, it is particularly present when fanfold sheet and the like are being fed. Fanfold sheet is usually supplied in relatively small cartons or stacks which can be readily handled by an individual worker. Thus, for continuous operation, each small quantity of fanfold sheet must be joined to the other. More specifically, the tail end of the pages, or the "footer", of a stack being used up must be joined readily and reliably to the first pages, or header, of the next stack to be processed.

Typically, fanfold paper will have perforated side edges suited for engagement by sprockets on the printing machine being fed. Thus, it is highly desirable that the hole-to-hole spacing across any splice be maintained. Splice joints must be made quickly and easily, and be strong and consistent. The splicing tape ought not run into the region where the sprocket-perforations are. Typically, the splice tape will have fine perforations running along its centerline, so that when the tape is used to make a splice, the fanfold sheet will not have a discrepancy insofar as fanfolding and segmentation is concerned. Thus, it is important that the perforation is carefully aligned with the joint between butt joined sheets. In the most basic way of joining sheets, an operator manually, and without mechanical guide, runs a piece of tape across the joint between, the header and footer while they are hand-held in proximity. Different fixtures have been employed, and of course there are a variety of commercial tape dispensers for applying tape to the surfaces of objects. Generally, the prior art splicing devices have either of two general types of inadequacies. Either they are cumbersome and slow to use, or they do not place the tape accurate ly. Consequently, there is a continuing quest for a splicer which has good performance, ease of use, reliability, and reasonable cost.

The present invention represents improvements on the invention described in the parent patent application and it provides all the benefits of the first invention. However, the invention of the parent application did not satisfy in good fashion the need for making quick and precise joints between sheets which lack perforations. And it is desirable to have a single splicer which is adapted for joining both perforated and non-perforated sheets. Making splice butt joints with minimal gap and no overlap in unperforated sheet presents a challenge. The convenience of achieving alignment by having perforations cooperate with pins of other features on the splicer is not present. So, it is quite difficult for an operator to accurately align the ends of the sheets being joined manually, and to quickly and accurately apply the tape.

An object of the invention is to provide a way for making splice joints precisely, reliably and quickly, between the ends of sheets; where the sheet may be either perforated or unperforated in various directions, of varying dimensions, and supplied in fanfold or in roll form. Another object of the invention is to lay tape on a splice joint so that the tape is centered on the joint and extends lengthwise from and to selected locations across sheet width; and to lay the tape down so that it well adhered across the whole length of the joint. Further objects of invention include: providing a means holding the ends of separate sheets, for splicing and other processing, which means is adapted to hold both perforated and unperforated sheet; providing a means for raising and lowering pin arrays relative to the surface of a device, where the pin arrays can be adjustably positioned at different locations on the surface. A further object is to achieve the foregoing objects by means of a device which is light in weight, economic to manufacture, durable and reliable, and safe to use.

SUMMARY

In accord with the invention, apparatus for splicing sheets comprises a base for supporting sheets to be spliced along a butt line, a top for clamping sheets for slitting or taping, and means for guiding either or both a tape dispenser carrier assembly (called DCC in the description) and a slitter carrier assembly (SCC). In a preferred embodiment, the SCC first slits the sheet with rearward motion along the top and the DCC applies the tape with forward motion. The SCC and DCC are interconnected by a body; the three components comprise the head. The SCC and DCC and parts thereof move relative to each other and the body in complex ways due to several clever mechanical design features.

In a preferred embodiment, the two carriers SCC and DCC are frictionally engaged in movable fashion with the guide means of the top. The guide means comprises two spaced apart C shape rails. The operator moves a handle connected to the body of the head, overcoming the friction and moving the two carriers, SCC and DCC, first in a rearward direction, to effect slitting when that is desired; and, then forward, to apply and cut tape. When sheets are to be slit, the rearward operator force on the body causes a spring biased slitter knife to drop downwardly and slit the sheet. When the head hits a rear stop, the slitting knife approaches close to the DCC. When the operator releases the rearward force, spring force causes the SCC to move forward and away from the DCC, and tape dispenser foot drops down into the space between the SCC and DCC, to start to apply tape to the surface of the sheets. As the head is moved forward and tape is laid on the sheet along the butt line, a wiper presses on the tape. The mechanical construction is such that it enables the foot to wiggle a bit and conform to variations in the surface of the sheet. When the head nears its forward-most position, it engages another stop which causes the foot to lift upwardly. Continued forward force by the operator causes a cutter located in proximity to the wiper to move forward and cut the tape as it runs through space from the sheet surface to the raised foot. When the tape is cut, the top is raised from the base, the spliced sheet is removed from the splicer, and the cycle may be repeated with new sheet. Some of the complex motions of the foot are carried out by means of a cam follower attached to the tape dispenser plate, which carries a roll of tape and the foot. The cam follower runs within a female cam surface, part of a plate which extends upwardly from the body.

The complex motions of the SCC and DCC enable the slitting to take place across the full width of sheets; and at the same time, they enable the application of tape precisely; as desired only along the width of the sheet, or less than the width of the sheet. Thus, the motion of the slitter knife is greater than the motion of the tape dispenser.

In further accord with the invention, when overlapped sheets are clamped within the apparatus, the sheets are slit, to thereby create a precise butt line. The slitting creates two trim pieces. Removal of one trim piece, to expose the butt line of the sheets is facilitated by the way in which the top clamps the sheet onto the base. The top has two resilient strips, one on each side of the butt line, which press on the sheets to hold them in place. One of the strips has a low coefficient of friction with the sheet. Thus, one of the sheet trim pieces, the one which overlies the mating sheet, can be pulled from the clamp without release of the clamp.

In further accord with the invention, the base has a combination of frictional clamps and retractable pin arrays. The frictional clamps are preferably magnetic clamps and include bases which are guide means for locating unperforated sheet on the base. The pin arrays are used when the sheet being perforated has edge perforations; in such case they are raised up from beneath the base to extend through holes and above the surface. Preferably, the pin arrays are part of a pivotable assembly beneath the base. The spacing between opposing end pin arrays and clamps is adjustable along the length of the base, so that different size sheets can be accommodated.

The apparatus and method of the invention enable the quick and accurate splicing of sheets, regardless of whether the sheets may be perforated or not. While some of the motions are complex, the number of parts are relative few and susceptible for ready manufacture. The preferred embodiment is entirely mechanical and therefore reliable and economic to manufacture and operate.

The foregoing and other objects, features and advantages of the present invention will become more apparent from the following description of preferred embodiments and accompanying drawings.

DESCRIPTION

The invention is principally described in terms of joining together the ends of paper sheets, where the pages are the ends of fanfold sheets of the type familiarly used in the printing industry. The invention will be understood to be applicable to joining together of pieces of other types of paper, and to joining together of thin sheets of various other materials. Fanfold sheet is also commonly referred to as fanfold paper, fanfold pages and fanfold forms. All the foregoing are terms of at, referring to a continuous piece of sheet material (which commonly comprises cellulose pulp but may comprise some other material such as plastic, etc.), where the continuous sheet has periodic creases or serrations, so that when received at a point, the sheet folds in a zig-zag fashion to form a stack. The individual segments are referred to as pages herein. Fanfold and other paper commonly has spaced apart holes or perforations along the opposing side edges of the pages of the sheet, to engage sprockets on the machines which process sheet, to enable positive feeding. As mentioned, the last pages from a first stack, or folded sheet, are called a footer; and, the first pages from a second stack, or folded sheet, are called a header. Paper sheet also is familiarly provided in the form of rolls. The end of a sheet of paper drawn from one roll must be connected to the beginning of sheet from a second roll. Roll sheet may be supplied with lengthwise edge perforations and transverse perforations which define pages.

Patent application Ser. No. 09/187,376, filed Nov. 6, 1998, now U.S. Pat. No. 6,331,222, entitled "Splicer for Joining Thin Sheets" describes various aspects of the present invention which are treated here in somewhat less detail. Accordingly, the description of the prior application is hereby incorporated by reference. The use of a splicer in connection with a conveyor device for fanfold sheet is described in related patent application Ser. No. 09/187,077, entitled "Fanfold Sheet Feeder Having Stack Postioner," now U.S. Pat. No. 6,142,288, having certain common inventorship and assignee herewith; and, the description thereof is hereby incorporated by reference.

Figure 1:
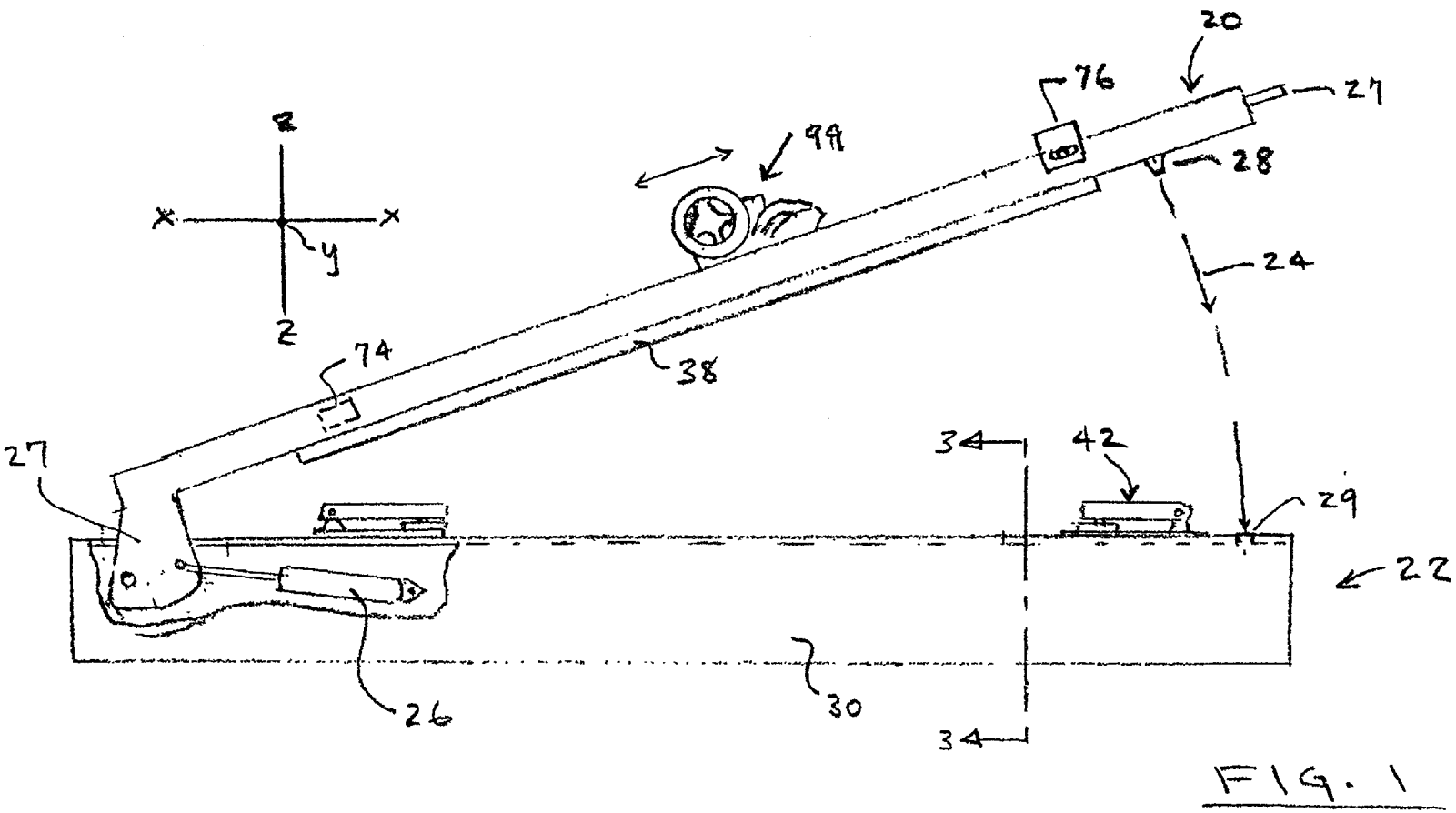
FIG. 1 is an elevation view of a splicer comprising a base and hinged top.
Figure 2:
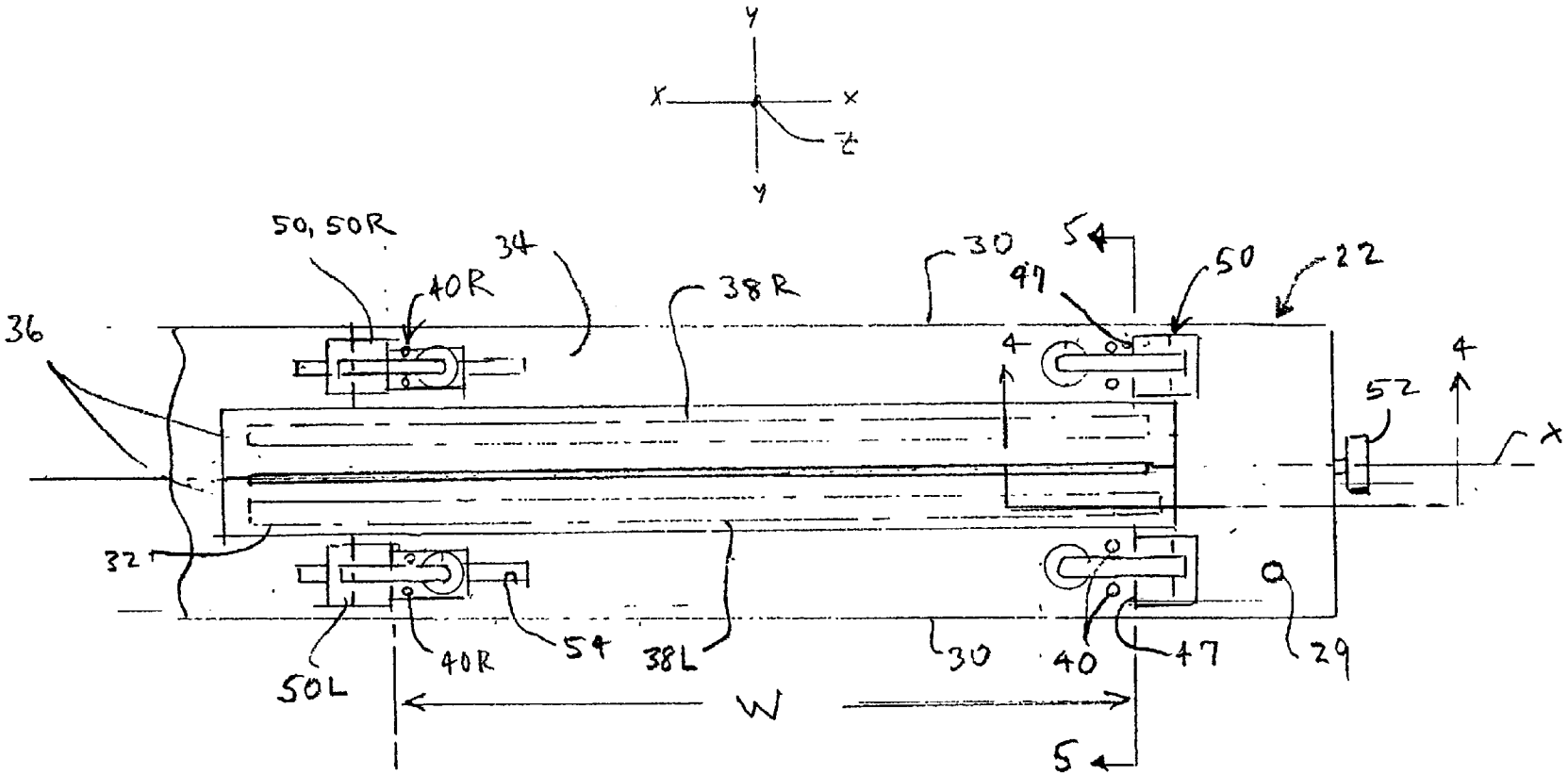
FIG. 2 is a top view of the base of the splicer showing in phantom where rubber pieces of the top lie when the top and base of the splicer are clamped together.
Figure 3:
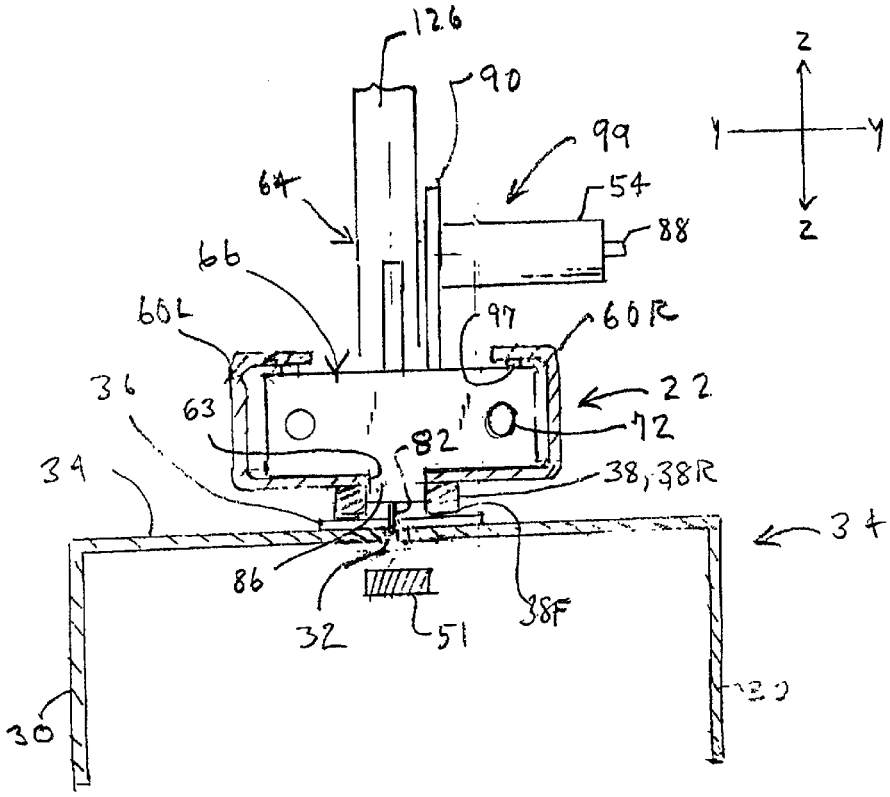
FIG. 3 is an end view cross section of the splicer with the top lowered onto the base, to clamp sheet in place.
Figure 4:
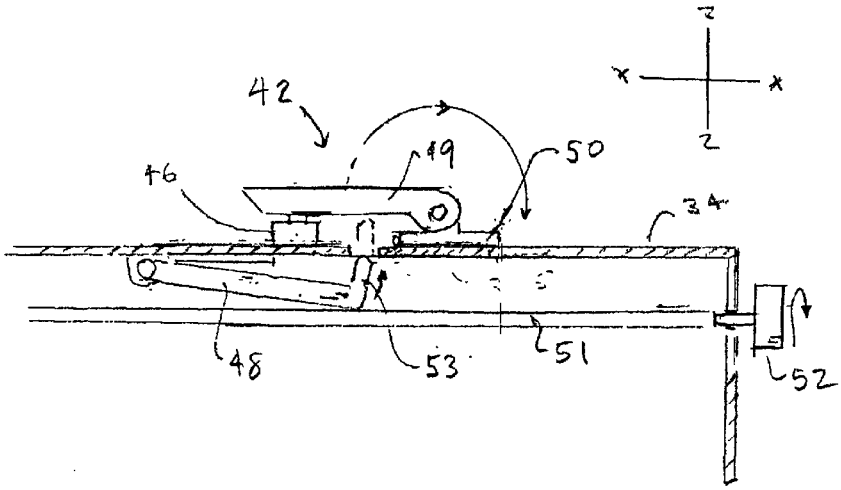
FIG. 4 is a lengthwise partial cross section of the front end of the base, showing a movable pin array and a sheet hold down.

FIG. 1 is an elevation view of a splicer, which is comprised of a top 20 pivotably mounted upon a base 22. FIG. 2. is a top view of the base. The front of the splicer is the end away from the hinge. The terms left and right as used herein are to be construed when looking at the device from the front end. Orthogonal x, y and z axes of the device are indicated in the Figures. FIGS. 3 and 5 are y-z plane cross section views of the base. FIG. 4 is a x-y plane cross section of portion of the front end of the base.

In summary, and to give perspective to the following description, ends of sheet are first positioned in the device, clamped in place, then optionally slit cross-wise, then taped, and then removed from the device. More specifically, the top clamps paper sheet between itself and the base, after the ends of sheets are positioned with use of magnetic sheet hold downs or retractable pins on the base. When (unperforated) sheets are clamped in overlapping fashion the overlapping portions are cut with the slitter. The trim piece of the top-most sheet is then pulled away without having to loosen the clamp. If the (perforated) sheets are butted, there is no slitting. To accomplish slitting, the head 99, which includes the slitter carrier, is manually moved along the length, or x axis, of the top, from front to rear, with the slitter knife exposed and operational. Then the head, which also includes a tape dispenser and wiper, is pulled from rear to front, to lay down the tape. When the head reaches the front end, or home position on the top, the tape is automatically cut by a knife in the head. The top is then raised to unclamp and remove the spliced together sheets.

Referring to FIG. 1, manual force on handle 27 is used to cause the hinged top 20 to rotate downwardly, as indicated by the arrow 24. Tapered pin 28 engages a hole 29 in the base 22, to align the outer, or front ends of the top and base. An captive air spring 26 acts in toggle fashion on the pivot plate 27 at the rear end of the top, thus causing the top to be retained in both its raised position and closed positions. Head 99, comprising a tape dispenser, wiper, slitter and tape cutter, runs along the length of the top. FIG. 3 shows the top in closed position. Instead of pivoting from the base, the top may be configured to move relative to the base in different ways. For instance, it may remain parallel to the base surface and move in the vertical direction, guided by appropriate rails.

The base is comprised of two opposing side bars 30, each having a right angle cross section. The spaced apart side bars 30 define a center slot 32. See FIGS. 2 and 5. For economy and rigidity of construction, a slot is cut in a c-shape channel to create the lengthwise bars 30. Alternately, bars 30 are metal angles connected by end plates. As will be seen, the slot 32 between the side bars of the base enables a slitter knife to cut sheet as it runs along the length of the base.

Two abutting strips 36 of high frictional engagement rubber run along the length of the top surface 34 of the base. An exemplary strip material is 0.030 inch thick neoprene rubber having a Shore A Durometer of about 90. There is a narrow gap between the two strips, corresponding with slot 32, to enable the slitter knife 82 to extend beneath the surface 34. See FIG. 3.

Two strips 38 of comparatively thick (e.g., ⅜ inch) foam elastomer, for example polyvinylchloride foam rubber which has 25% deflection at 4 psi load, run along the underside surface of the top. FIG. 3 shows how the strips 38 mate with the base when the top is closed. See also the strips shown in phantom, superimposed on the base shown in FIG. 2. The strip on one side, e.g., the right strip 38R in FIG. 3, has a very smooth anti-friction surface where it contacts the matting strip 36 on the top surface of the base. For instance, a 0.001 inch thick film 38F of Delrin™ acetal plastic is applied to the lower side of strip 38R. In comparison, the left strip 38L in FIG. 3 has a normal frictional surface. Thus, when the top is lowered onto the base, any sheet lying on the surface 34 beneath the strips 38 will be captured or clamped in place. See FIG. 21A. The purpose of the anti-friction surface on strip 38R is described below.

When sheets are laid on the surface of the base, they are aligned in two ways, depending on whether or not there are edge length perforations in the sheet. When the sheet has perforations, the perforations are engaged with pins 40 which are caused to protrude above the surface of the base. When the sheet lacks perforations, the pins are lowered beneath the surface of the base and the sheets are held by means of frictional sheet hold down assemblies 42. The pins and hold down assemblies are integrated into two components, one at each end of the base. Each component comprises two sets of pins and two sets of magnetic sheet hold downs. The construction and function of the pin portion is described first.

As shown in FIGS. 2, 4 and 5, the two opposing sets of pins 40 at the front end are mounted on a pin block 48 which is pivotably mounted from the underside of the bars 30 of the base. The free end 53 of the block 48 rests on rectangular cross section pin rod 51 which runs the length of the base. The pin rod 51 is manually rotated a quarter turn by means of knob 52. As illustrated in FIG. 5, when the rod 51 is in a first horizontally flat position, the pins are beneath the surface of the base. When; the pin rod 51 is rotated a quarter turn, to a vertical position shown in phantom 51P, the pin block is raised and the pins project above the surface, as indicated in phantom 40P. The pin array 46R at the rear end of die base operates similarly, except that the pin and sheet hold down assembly are movable lengthwise as described below. The design of the pin rod and bin block is such that the pins will able to be lifted no matter where along the base length the rear pin block assemblies are positioned. Thus, the spacing W between the opposing pins and sheet hold downs can be adjusted to suit the width of the sheet being processed. It will be apparent that the front pin blocks and sheet hold downs can also be adjustable along the length, although it is preferred to have them fixed for purposes of convenient utility and setup.

In alternate embodiments of the invention, the pins may be retracted in other means, such as by tilting; or if only perforated sheet is being processed, they can be fixed.

As illustrated by FIGS. 2 and 3, there are two pairs of sheet hold down subassemblies 42. Each subassembly is comprised of an arm 49 which is pivotable from a sheet hold down base plate 50 which is engaged with the surface of the base. When the sheet hold downs are not being used, in favor of the pins, the sheet hold down arms are swung out of the way as indicated by the arrow in FIG. 4. When the sheet hold downs are used, the paper is first aligned by engaging the inner y axis edges 47 of the base plates 50. The sheet hold downs are then swung downwardly onto the surface 34 of the base, to a position shown in FIGS. 2, 4, and 5 (in phantom). The sheet is thus frictionally captured between surface 34 and sheet hold down pad 46. In one embodiment the sheet hold down pads 46 comprise magnets and the base is metal.

Figure 5A:
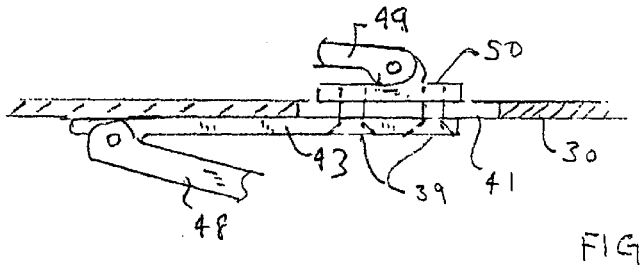
FIG. 5A is a side elevation view showing an assembly combining movable pins and a pivotable hold down clamp, which is movable along the base.
Figure 5:
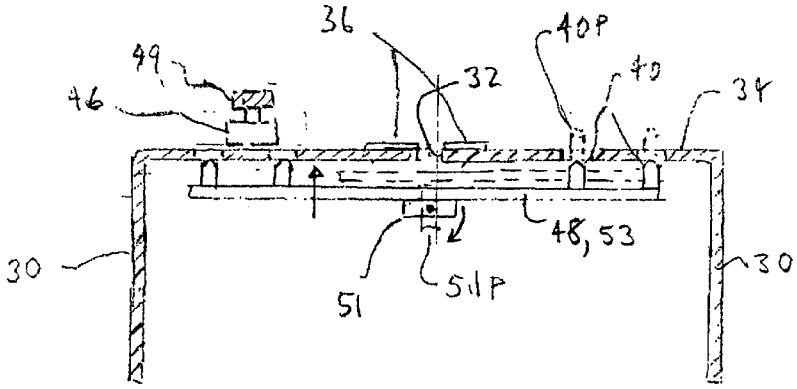
FIG. 5 is an end view cross section of the base showing the movable pin array and pin bar actuator mechanism.
Figure 5B:
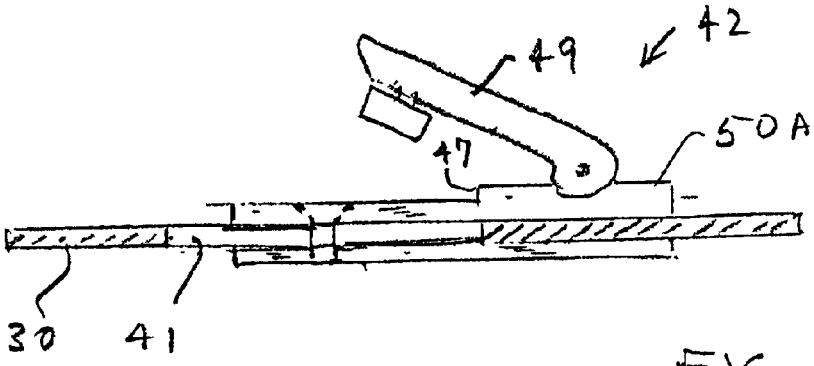
FIG. 5B is view like FIG. 5A, showing an alternative hold down clamp with a magnetic base plate.

If the base of the splicer is a non-magnetic material such as the preferred 304 stainless steel, then, with reference to FIG. 5B, the base plate 50A can be made of thin magnetic material, so it extends lengthwise, and so it has a step which defines the aligning edge 47. Alternately, a spring or toggle action may be employed to provide downward force on the sheet hold down pad.

FIG. 5A shows how the pin sets and pivotable hold down are combined into an assembly which can be adjustably positioned along the length of the base. The base 22 has a lengthwise slot 41. The pin block is pivoted from subplate 43. The hold down pivots from base plate 50. Screw pins extend through the slot 41, to connect to the plate 50 and subplate 43. Tightening the pins locks the assembly in a desired location.

Figure 6:
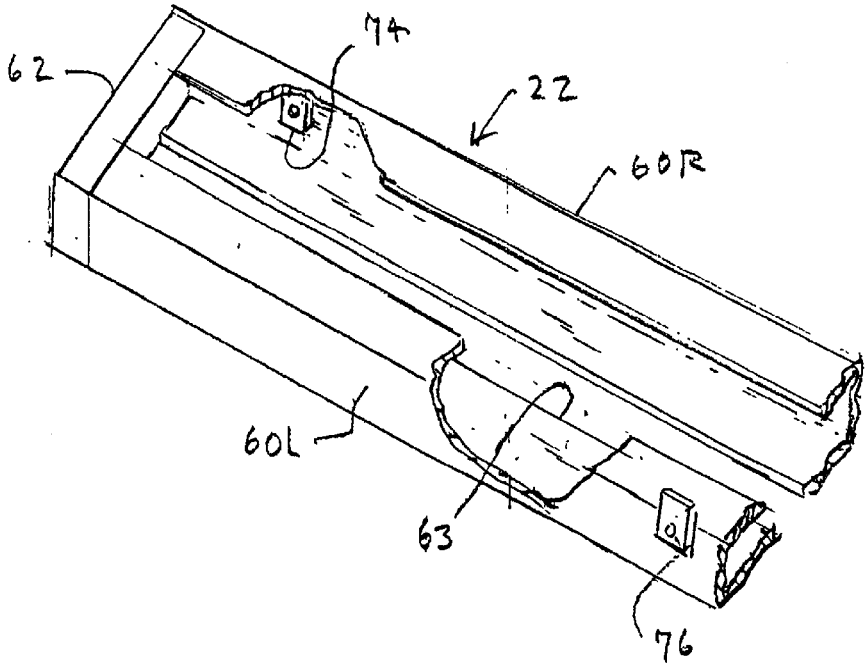
FIG. 6 shows in partial cutaway a major part of the rear end of the essential two-rail assembly of the top as it appears when moving rearward.

The head 99 is an assembly of components which runs lengthwise along the x axis, guided by the essential structure of the top, comprised of two opposing c-shape cross section rails 60. See FIG. 5. FIG. 6 shows how the left and right c-shape cross section rails 60L and 60R are fastened to end pieces, one end piece 62 of which is shown in FIG. 6. The lower inner edges of the two rails define lengthwise slot 63. The slot edges control the position of the two principal supporting members of the head, namely the carriers, as they move on a guided path relative to the base and the sheet joint, when the top is lowered on the base to clamp sheet in place.

Figure 7:
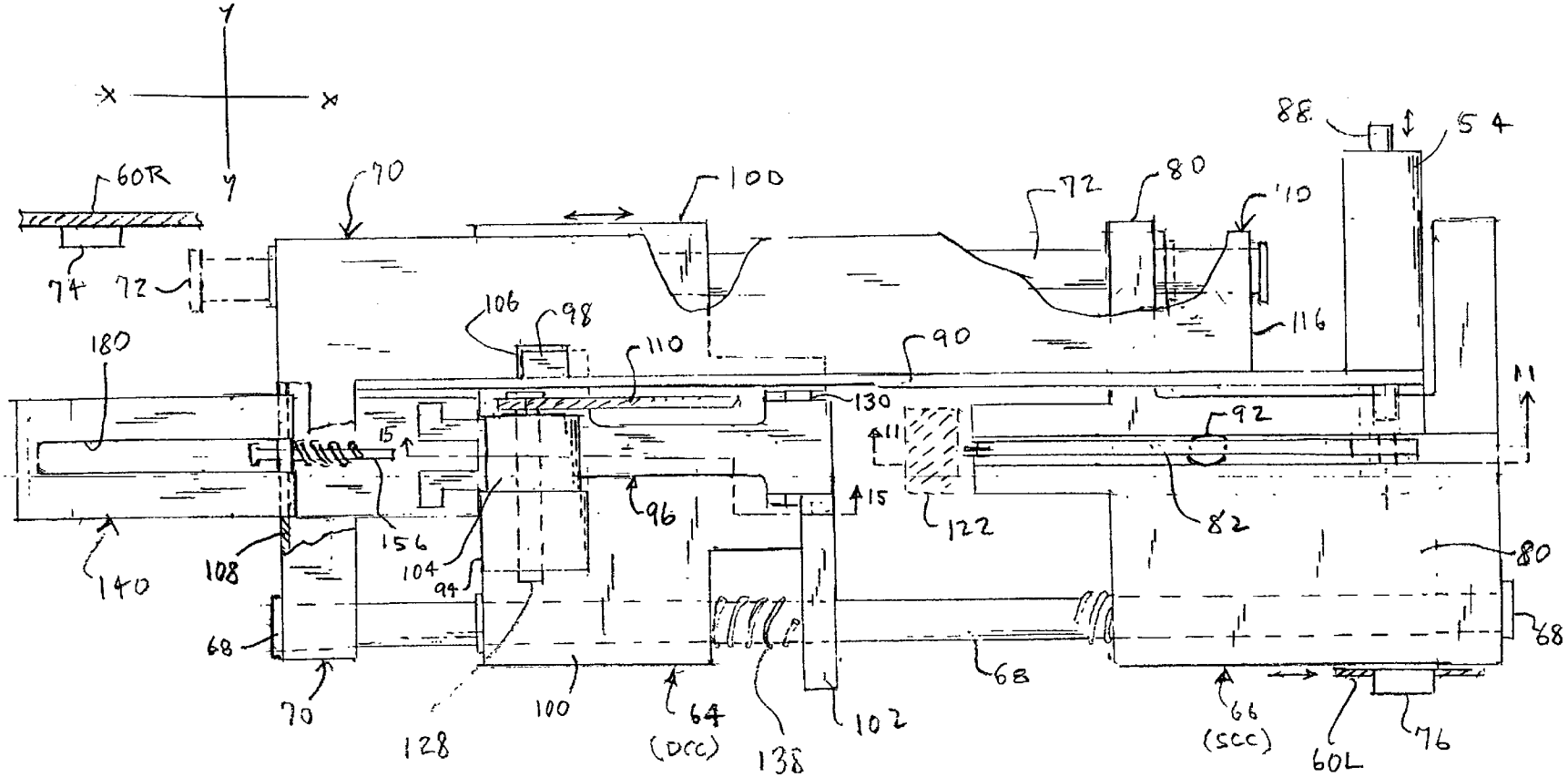
FIG. 7 is a top view of the head assembly shown in FIG. 6.
Figure 8:
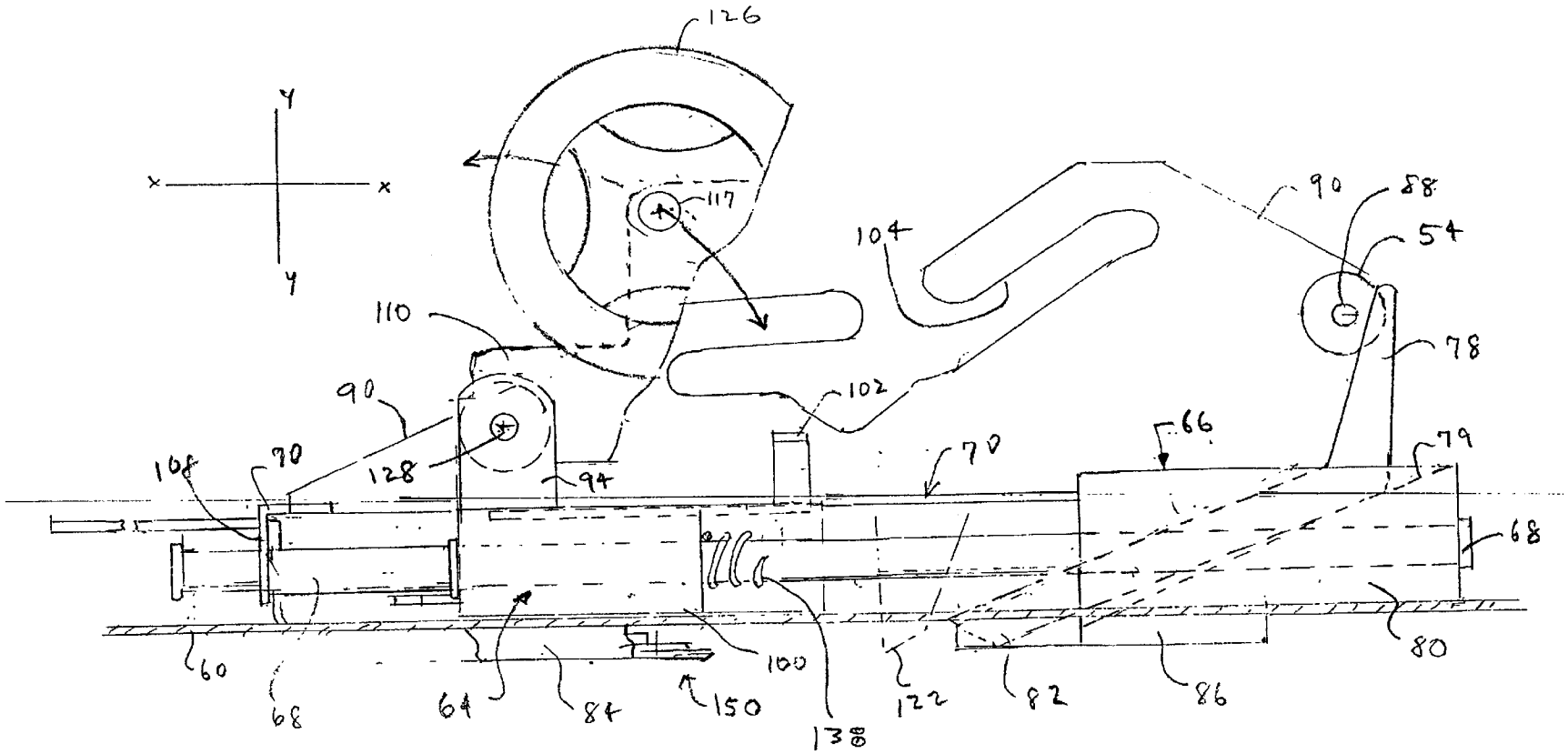
FIG. 8 is a left side elevation view of the head assembly.

FIGS. 7 and 8 are respectively top and elevation side views of the head assembly. The head 99 is comprised of three main components: two carriers and a main body riding on the carriers; namely an assembly called the dispenser-cutter carrier (or "DCC") 64, an assembly called the slitter carrier ("SCC") 66, and an assembly called the main body 70.

The SCC 66 is positioned in front of the DCC. Rectangular bosses 86 and 84 project respectively from the bottom sides of the SCC and DCC, to key into the slot 63 of the top and constrain motion in the x axis direction. See FIG. 3. There are y axis clearances between the insides of the vertical portions of rails 60 and the outsides of the carriers. Vertical z axis motion is constrained by Delrin™ (Dupont Co.) spring pins 97 which extend upward from the top surfaces of the carriers, to push them downward by acting against the underside of rails 60. See FIGS. 3 and 22.

Left guide rod 68 and right guide rod 72 interconnect the SCC, DCC, and main body and aid alignments and cooperation between the parts. The rods are largely slidably engaged with the several components, as the details and functioning below indicate. A spring 138 is compressed upon the left guide rod 68. The slides, or basic bodies, of the carriers are made of acetal resin thermoplastic, such as Delrin. The main body and guide rods are metal. All metal components, except those plates adapted to receive the magnetic sheet hold down pads, are made of AISI 304 stainless steel.

The amount of longitudinal, or x axis, frictional force, f, between the carriers and the surfaces of the rails which they contact is important to the functioning of the invention. The amount of f has to be made sufficient such that when one carrier is moved toward or away from another, the desired relative response in movement of the other carrier is engendered, as will be described. The means by which the amount of f is set comprise the combination of finish on the rails 60 (mill finish being preferred) where they contact the carrier bodies and spring pins, the amount of vertical force of the spring pins, and lubricant, such as solid film lubricant, applied to the rails.

The main body interconnects the carriers, transmitting force to the bodies of the carriers, to drive them fore and aft, in the x direction, when main body handle 54 is manually moved. The carriers move in complex ways relative to the motion of the main body. The response of the carriers to a given main body movement is modulated by intentional play between the elements of the head, the guide rod springs, and the stops. Thus, the spacing between the DCC and SCC varies along the x axis travel path, principally at the ends. And, the x axis velocity profiles of the carriers vary relative to each other and to the main body, as an operator moves the handle manually at constant velocity, first toward the rear (called "minus x" or "negative" direction and velocity), and then toward the front ("plus x" or "positive").

Travel of the head 99 toward the front and rear is limited respectively by front stop 74 and rear stop 76, the positions of which are adjustable. The relative variations in velocity of the carriers and main body are a result of a change in the relative spacing of the carriers. The variation in spacing is either necessary for, or a result of, achieving the proper slitting of the sheet, the laying down of the tape, and the cutting of the tape, all in a manner which protects to a great degree the operator from inadvertent contact with a cutting edge. The variation of spacing is necessary not only to enable proper function of the blade of the tape cutter and to avoid interference of the components as they move, but to ensure that the sheet is fully slit and that the tape is laid only where the operator desires it, whether that is from edge to edge of the sheet, or to/from a point inboard of the sheet edges.

The motions will be first described, with the assumption that the handle 54 is being moved at a constant velocity from a first position, the front home position, to a second, rear most) position, followed by a short pause, and then moved at more or less constant velocity back to the home position. A cycle of motion comprises movement from the front, to the rear, and return to home. The following description should impart an appreciation of the mechanical features, interconnections and interactions of the components which are then described.

Figure 9:
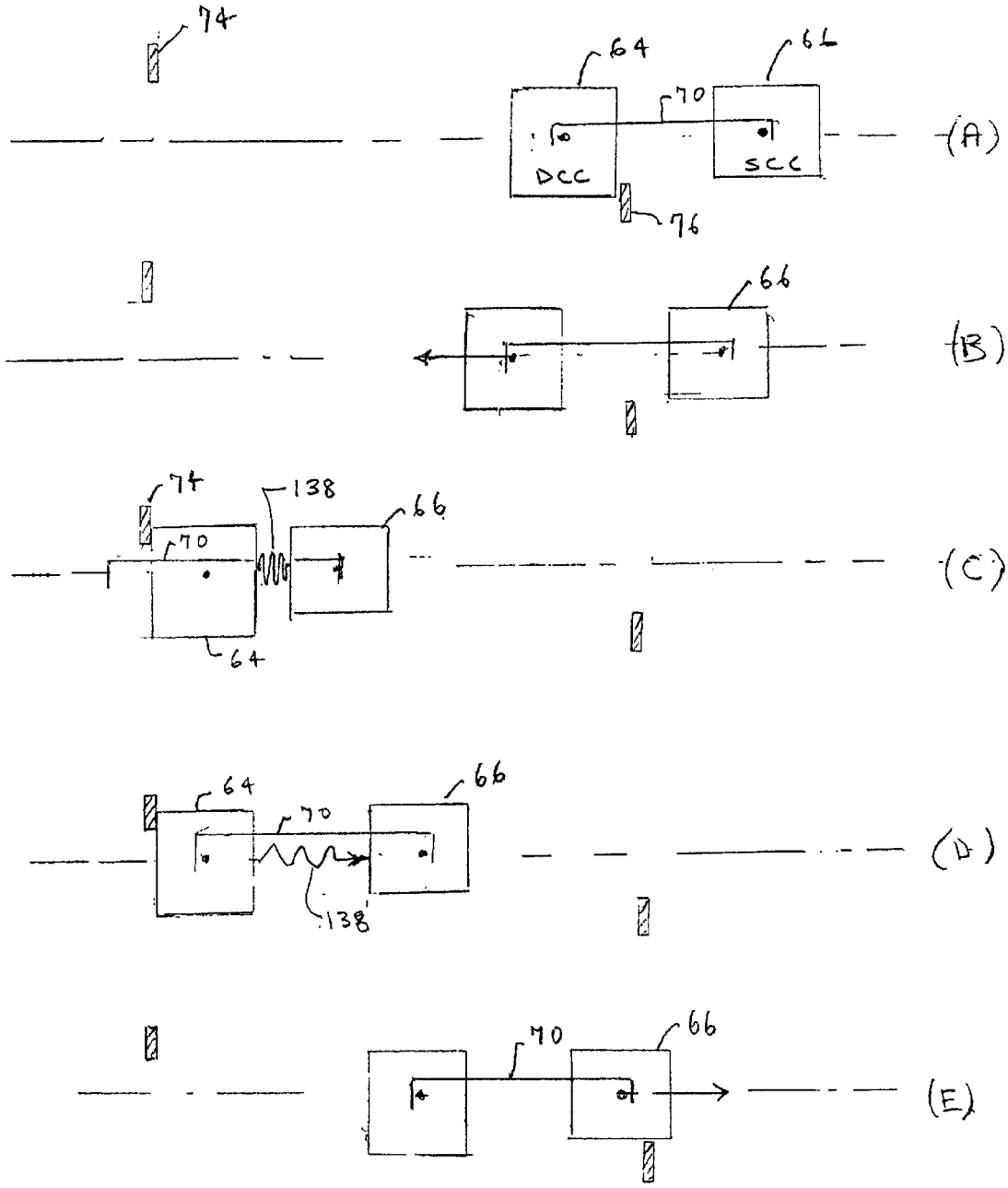
FIG. 9 schematically shows the relative longitudinal positions of the slitter carrier, dispenser-cutter carrier and body during the operational cycle which includes slitting and taping.
Figure 10:
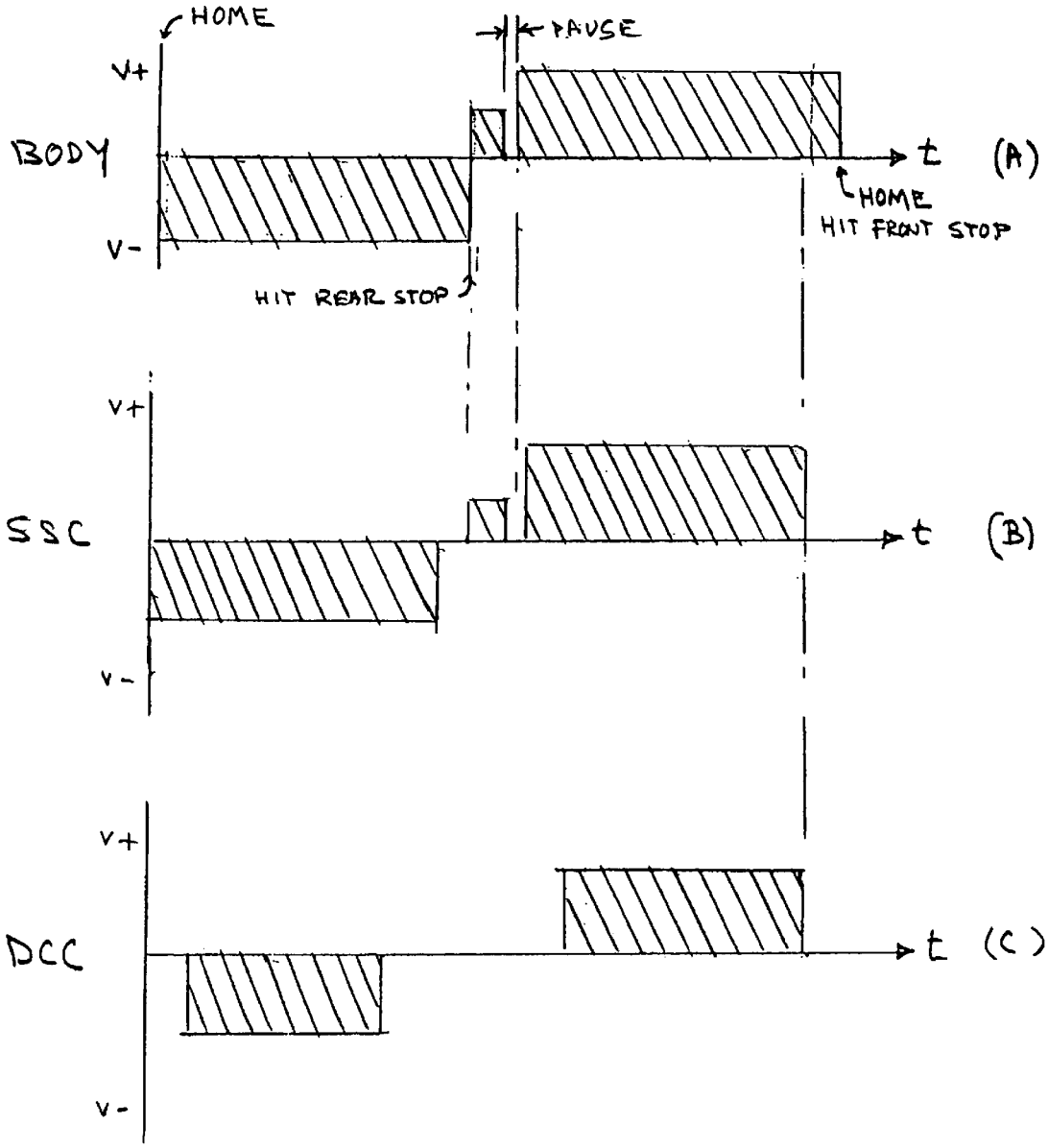
FIG. 10 graphically shows the velocity and position profiles of the slitter carrier, dispenser-cutter carrier, and body components of the head.

FIG. 9 schematically shows how the spacing of the DCC 64 and SCC 66, and the position of the body 70 relative to each, varies according to the direction of motion is positive or negative, and the point in the cycle. FIG. 10 graphically shows how the velocity varies with time of a cycle for each of the three components. The figures are schematic and only loosely quantitative or scalable.

In FIG. 9(A), the carriers 64, 66 are shown when at their home positions. As the main body 70 is moved in the negative or rearward direction at constant velocity, the carriers move with unchanged-spacing at constant velocity. See FIG. 10 and FIG. 9(B). During this phase the slitting of sheet is taking place. The motion continues until DCC 64 hits the roar stop 74. As the operator continues to move the body toward the rear stop, the carrier SCC 66 moves very close to the DCC, compressing spring 138 which is on a guide bar running between the two carriers. See FIG. 9(C). During this time the slitting is being completed. The operator then releases the force on the handle of body 70. As the spring relaxes, it pushes the carriers apart, and as a side effect, moves the body in the forward or x positive direction. See FIG. 9(D). This enables the tape dispenser foot to become positioned in between the carriers, for the beginning of the taping step. At this point, the operator optionally pauses further in applying any manual force and removes any trim sheet resulting from slitting of overlapped sheets. See FIG. 10A. Next, the operator commences to pull on the body in the x positive, or forward, direction. During this motion, dispenser foot contacts the sheet, and tape is laid down on the sheet to form the joint. The spacing between the carriers remains constant as the carriers move in coupled fashion in the positive direction. See FIG. 9(E). The plus x motion of the components continues until DCC 64 hits the front stop 76, as illustrated by FIG. 9(A), and is at the home position. Hitting of the front stop induces cutting of the tape. The operator then raises the top, to unclamp the sheet from the splicer, completing the full splicing cycle.

Figure 11:
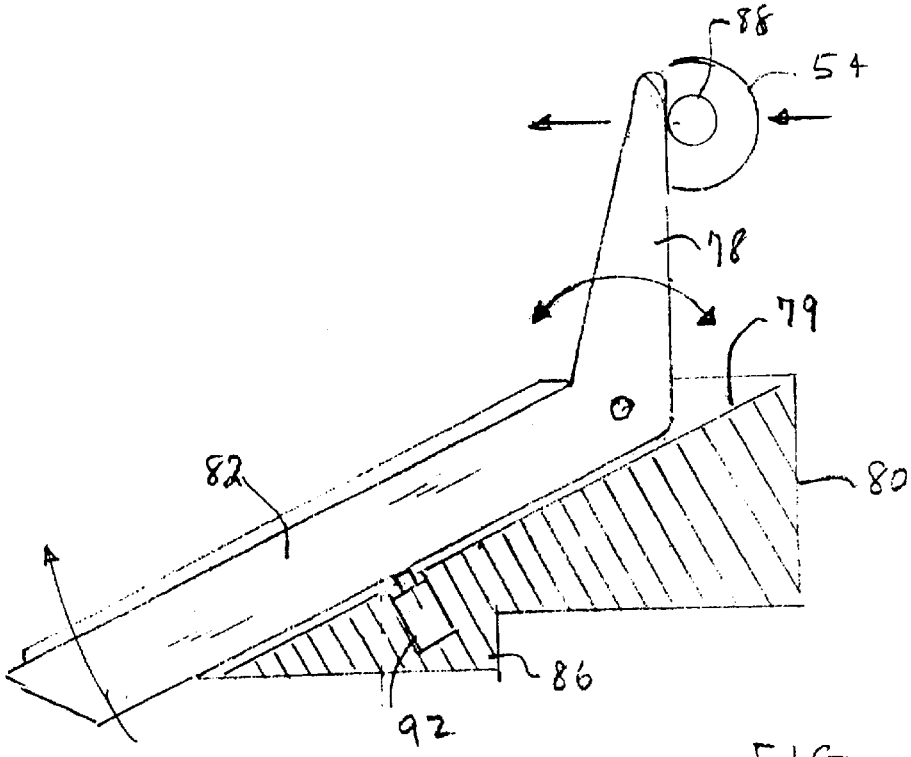
FIG. 11 is a vertical near-centerline cross section of the slitter carrier, showing the slitter knife.

Referring to FIGS. 8, 9 and 3, and to the centerline vertical cross section of FIG. 11, the SCC 66 is comprised of slitter slide 80, made of plastic, which has a sloped slot 79, within which pivots an L-shape knife 82. The knife is biased to rotate upwardly within the slot by spring pin 92. The upper arm 78 of the knife 82 projects vertically from the slide. The body 70 comprises a cam plate 70, to which is attached handle 54. Within the handle is a pin 88 which the operator can slide axially by her thumb. According to the axial position of the pin 88 of handle 54, the pin will or will not engage the arm 78 when the handle is moved in either direction. When the pin is extended so that it projects into the plane of motion of the arm, and when the handle 54 is moved rearwardly, the pin pushes the arm 78 rearward, rotating the knife 82 against the bias of spring pin 92, causing the lower cutting edge tip of the knife to move below the lower surface of the boss 86 at the bottom of the SCC, and out of the slot 32 of the base. See FIG. 3. Thus, if the handle, body, SCC and head as a whole are moved further rearward, sheet clamped within the splicer is slit by the knife. If rearward force is relaxed at any time, the spring pin 92 causes the tip of the knife to rise a bit, causing the cutting edge of the knife to retreat safely within the slot, as the knife is shown in FIG. 8.

Referring to FIGS. 7–10 and others, the dispenser-cutter carrier, DCC 64, is comprised of slide 100 which is made of plastic. The slide has an upward extending pad 94, from which a dispenser plate 110 is pivotably mounted. The dispenser plate carries a spool 124 upon which is mounted a roll of tape 126. The plate also carries a foot 122 which guides the tape onto the sheet. The slide 100 also carries the wiper-cutter assembly 150 (WCA). The cutting and wiping end of the WCA is beneath the lower surface of the slide 100. The WCA moves fore and aft, partially within the slide, during use. The slide also carries a pivotable latch 96 which is adapted to selectively couple and uncouple a fixed connection between the slide and the body. The latch 96 also interacts with the forward stop to limit DCC travel in the forward direction.

Figure 13:
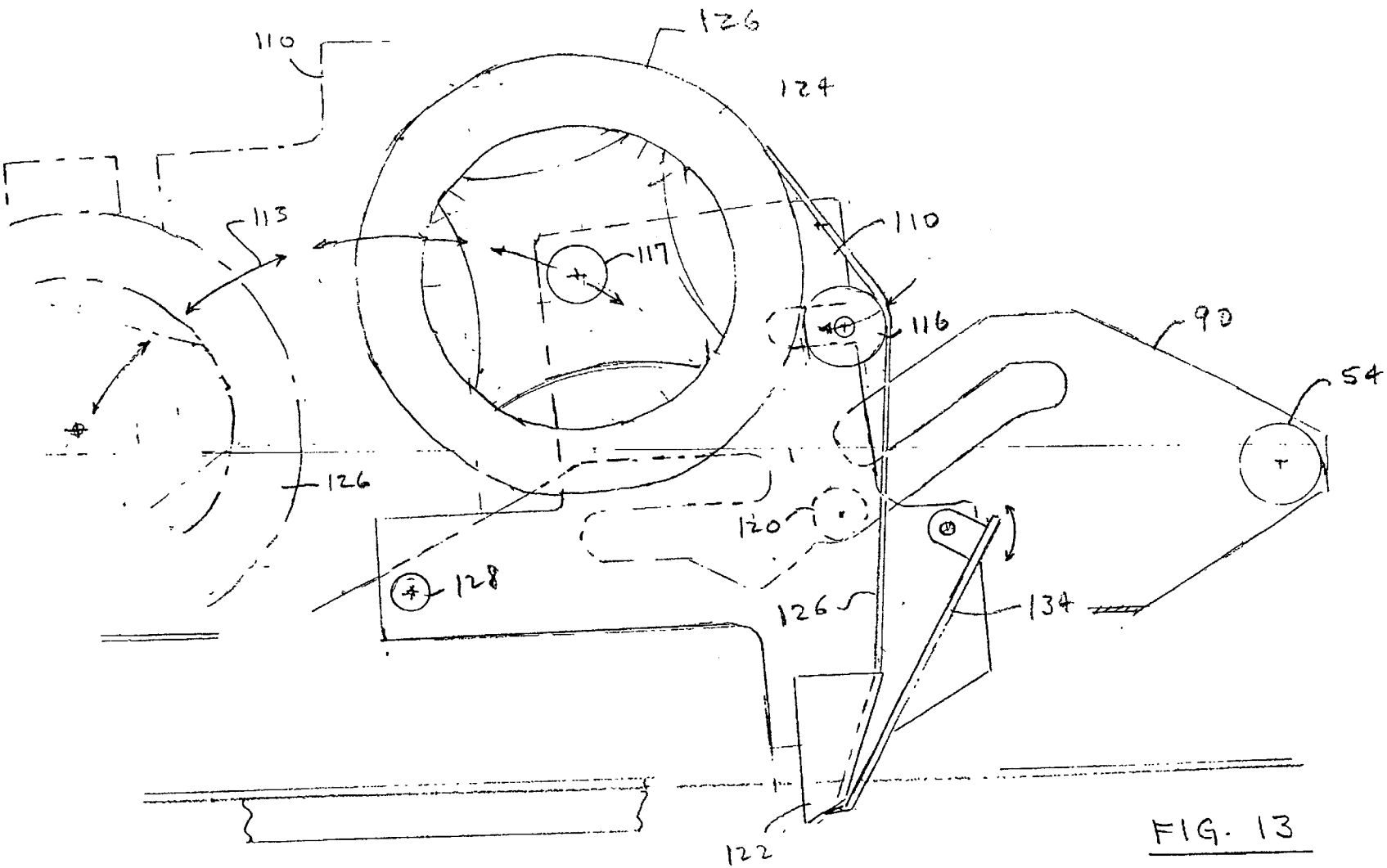
FIG. 13 is a left side elevation view of the dispenser plate and associated parts, including a roll of tape, showing how the dispenser plate is rotatable out of its working position.
Figure 14:
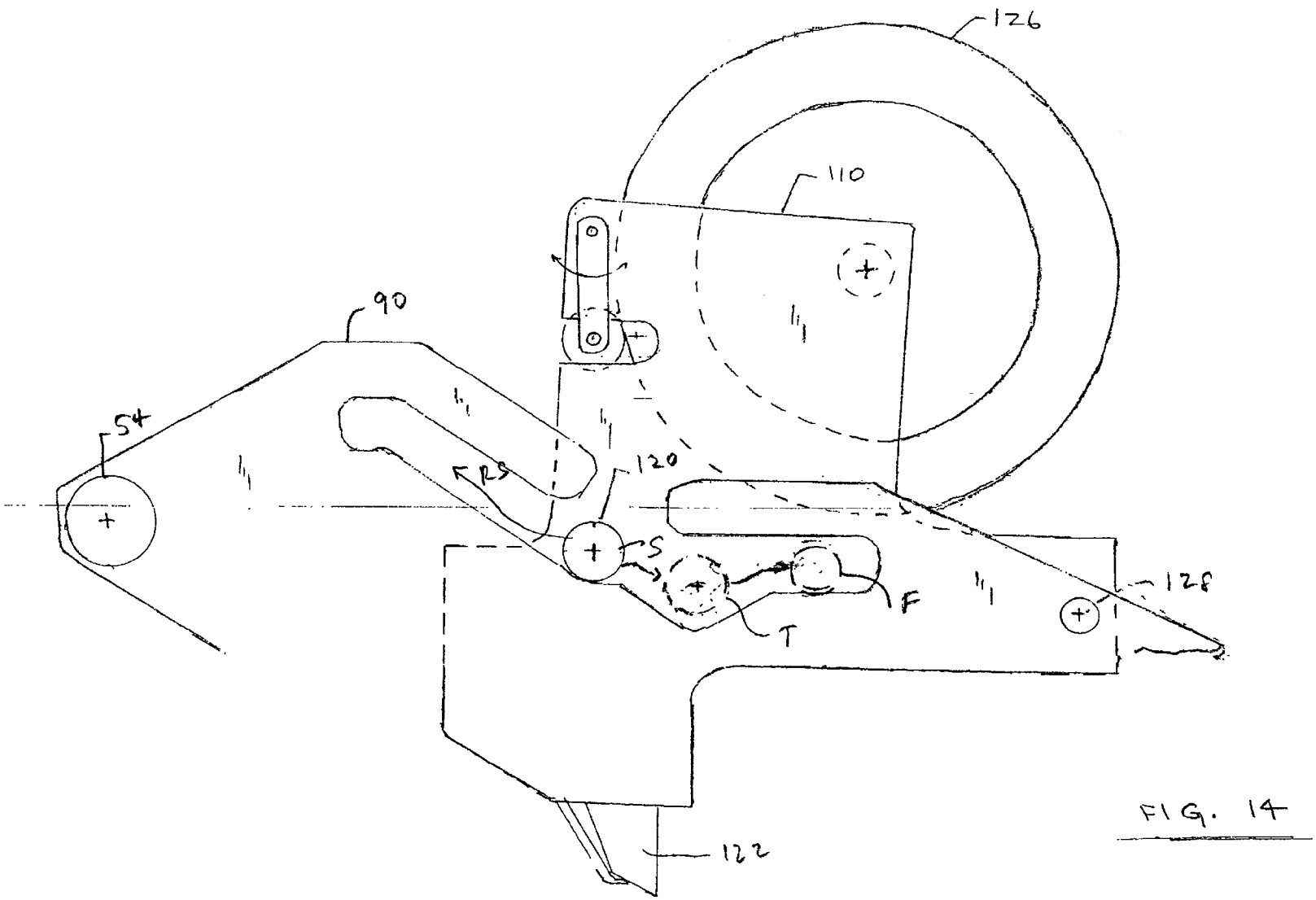
FIG. 14 is a right side elevation view of the dispenser plate, showing where the cam follower on the dispenser plate is located within the cavity of the cam plate, at different points of x axis motion of the head assembly and main body.

The tape dispenser plate 110 is shown in more detail in the left and right side elevations of FIGS. 13 and 14 respectively. Rotatable tape spool 124 is mounted on stub axle 117. Tape 126 runs around the spool in roll form. The tape 126 issues from the roll and spool, constrained by spring biased idler 116, and runs downwardly to the foot 122, as shown in FIG. 13. The foot contacts the sheet during the tape application phase of the operational cycle as described below.

The dispenser plate is mounted at the end of a shaft 128 on which there is a spacer 104. See FIG. 7. The spacer, the pivot bore in the dispenser plate, and the shaft 128 are configured so that there is play between the components. Thus, the mounting causes the plate to essentially rotate in the x-z plane, but at the same time the play enables the plate to rock slightly left-right out of the plane, thus enabling the foot 122 which is mounted on the plate to rock slightly left-right, to thus accommodate uneven-ness along the butt line between sheet lying on the surface of the base 22.

The dispenser plate 110 has a cam follower 120 which projects laterally from the vertical surface of the plate. The cam follower engages cam plate 90 which is an upwardly extending portion of the main body 70. As described below, the cam follower causes the dispenser plate, and thus the foot, to rotate vertically upward and downward at selected times during the cycle.

The slide 100 of the DCC 64 also carries a pivotable latch 96 which has a left tang 102 configured to engage the front stop 76 and a right tang configured to engage a slot in the horizontal surface of the body 70. See FIGS. 7 and 15 in particular. When the left tang hits the front stop 76 as the head 99 moves toward the front of the splicer, the latch pivots about axle 130, against the bias of spring 132 (which also biases the cutter assembly, as described below). Normally, the right side tang 98 is longitudinally engaged with a slot 106 in the main body. When the latch pivots, the tang lifts from the slot and the main body is disengaged from the DCC of which slide 100 is part. The disengagement enables the body 70 to move in the plus x direction relative to the DCC, as described below.

Figure 15:
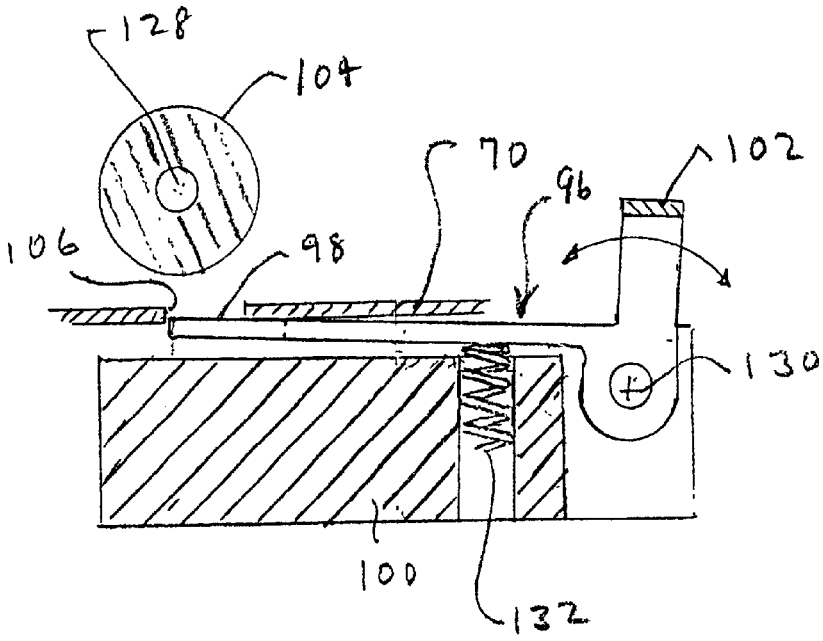
FIG. 15 is a left side elevation cross section view of parts of the dispenser cutter carrier which are related to a latch which selectively engages the main body.

The top surface of right side tang 98 of the latch slopes upwardly in the rearward direction of the splicer, as shown in FIG. 15. Thus, the spring biased tang 98 will press against the underside of the body 70, but will only engage the slot when the motion of the main body is in the forward direction relative to the slide 100 and the DCC, i.e., when the travel is to the right in the FIG. 15 illustration. When the motion is in the opposite direction, the tang will not engage the body.

Figure 16:
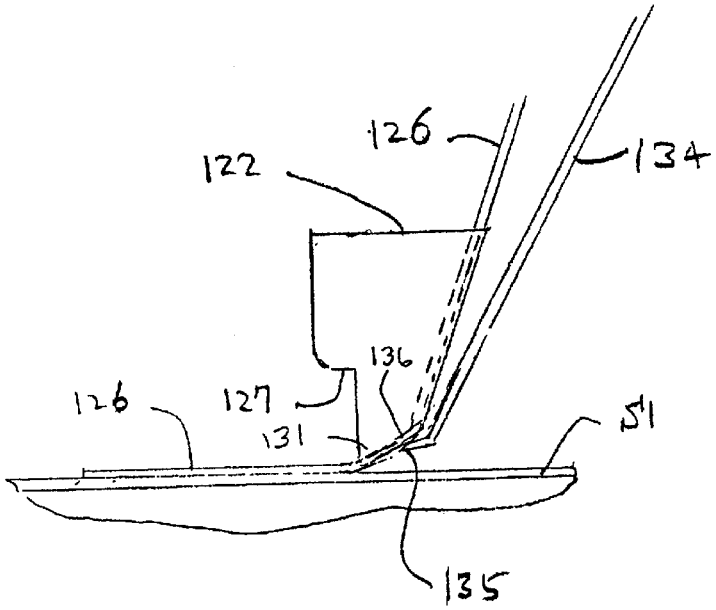
FIG. 16 is a left side vertical elevation view of the foot and keeper, showing how tape is laid on sheet.
Figure 17:
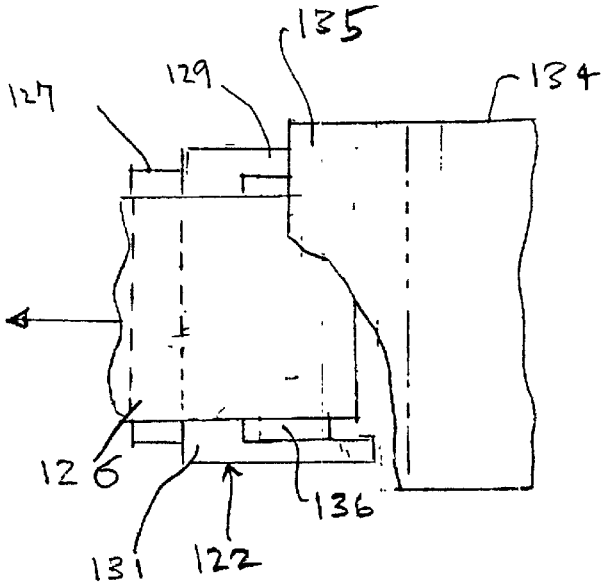
FIG. 17 is a view upward along the z axis of the parts shown in FIG. 16.

As is explained further below, the foot 122 delivers splicing tape to the surface of sheet at the joint. The side elevation view of FIG. 16 and the view of FIG. 17, looking up the z axis from beneath, show foot 122 with tape 126 from the roll running around it. See also FIG. 13. The Figures show in more detail how the foot and an associated keeper 134 are configured. Referring to FIG. 13, the keeper 134 is pivotably mounted off the dispenser plate. An unshown spring biases the hooked and tapered lower end of the keeper, so it presses against the foot. Typically, the Scotch® Magic™ Tape has a thickness of about 0.002 inch, The foot is made of Delrin thermoplastic. The foot 122 has a channel 136, defined by opposing lengthwise running abutments 131. The channel is slightly both deeper and wider than the thickness and width of the tape. For instance, for the particular tape mentioned just above, the channel is about 0.010 inch deep. The keeper in its rest position contacts the abutments 131, thus importantly preventing the keeper from normally engaging the tape exposed surface as it runs along the channel of the foot, which surface of course contains the adhesive. The primary function of the keeper is to position the tape when the tape roll is replaced or the tape is otherwise manually moved. It is found that after a tape strip has been first laid down on a sheet, frictional engagement of the typical tape with the compound angle of the foot is effective in keeping the tape in place, after it is cut at the end of a joint and during the time of further motions, until the tape laying is repeated.

Figure 18:
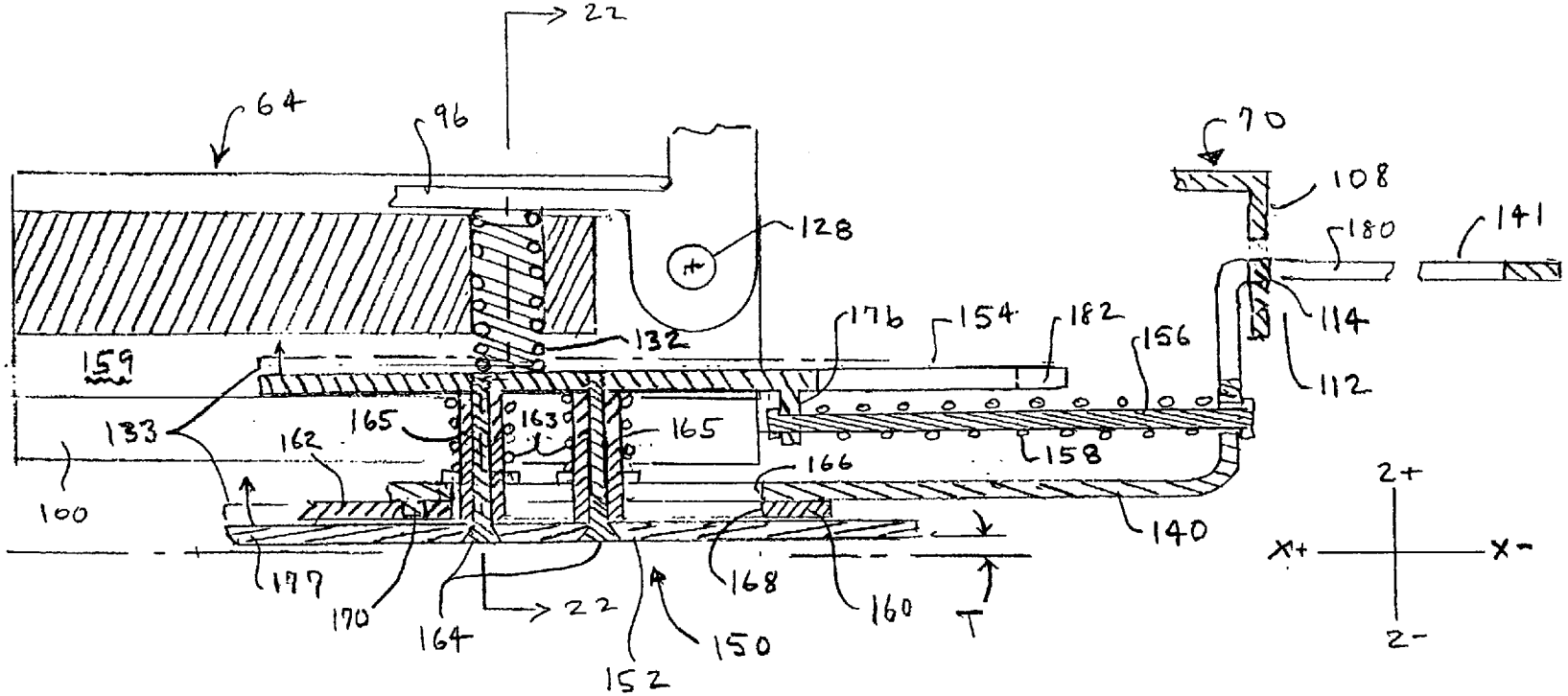
FIG. 18 is a right side centerline cross section elevation view of the dispenser-cutter carrier, showing the wiper cutter assembly with the cutter in the home position.
Figure 19:
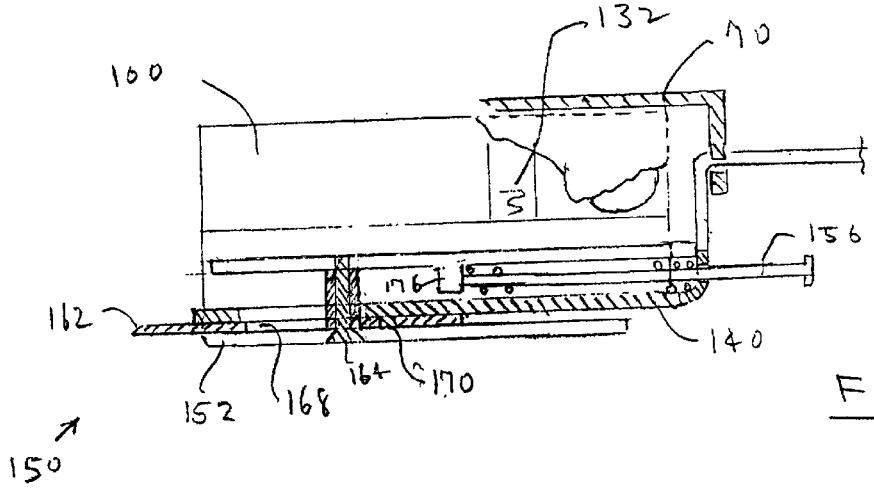
FIG. 19 is like FIG. 18, showing the cutter in its activated, or tape cutting position.
Figure 22:
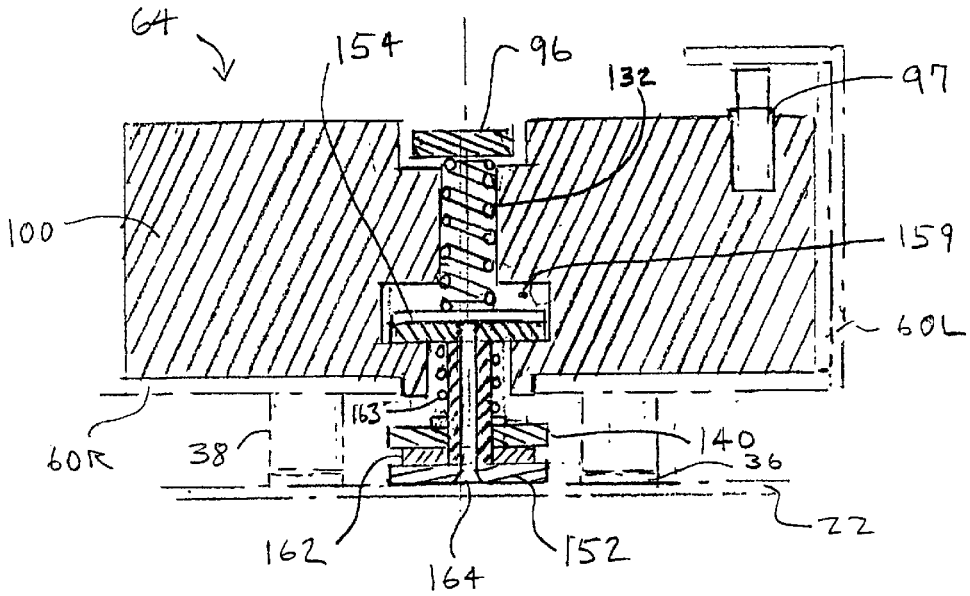
FIG. 22 is a vertical cross section y-z, or transverse, plane view of the dispenser-cutter carrier assembly, particularly showing the tape cutter assembly.
Figure 23:
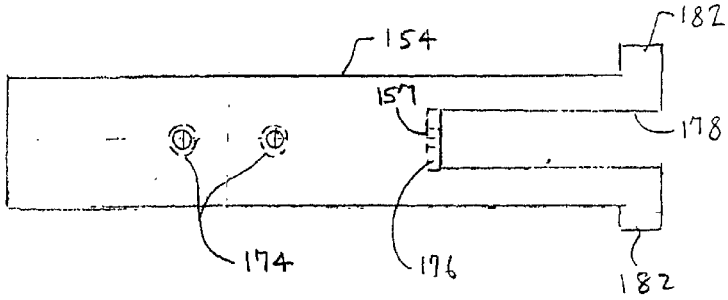
FIG. 23 is top view of the tee bar of the cutter assembly.
Figure 24:
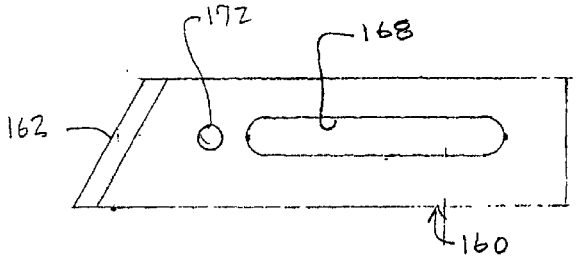
FIG. 24 is a top view of the blade of the cutter assembly.
Figure 25:
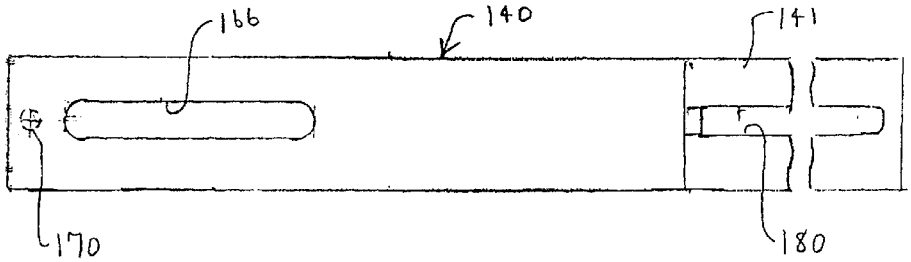
FIG. 25 is a top view of the actuator of the cutter assembly.
Figure 26:
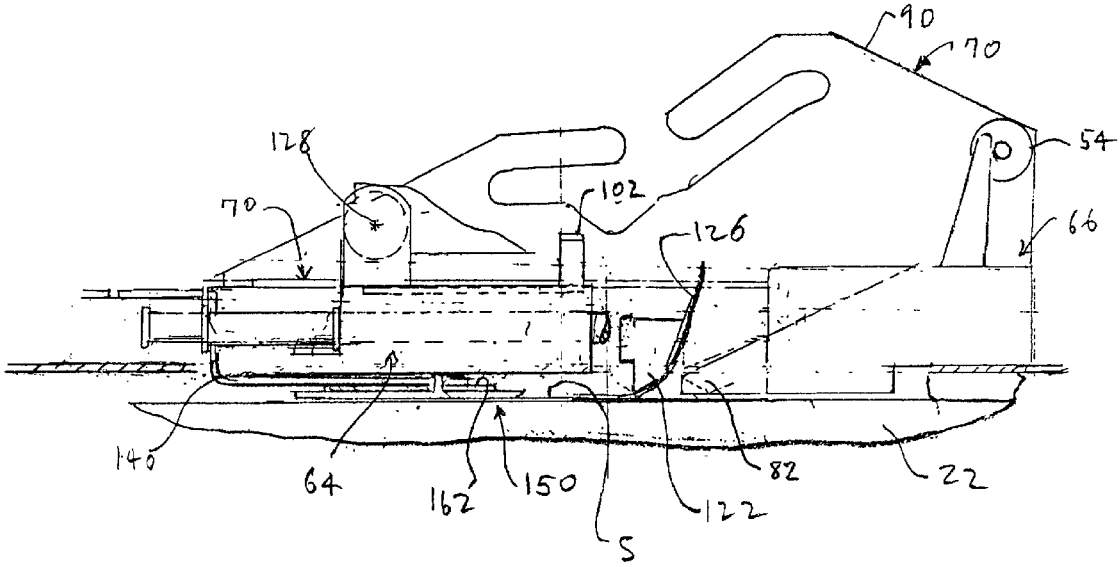
FIG. 26 is a side elevation view of the carriers and body, showing the relative positions and the path of tape being laid.

The wiper and cutter assembly 150 ("WCA") is a mechanism for pressing the tape onto the surface of the sheet as it is being laid, and for accurately cutting the tape at the end of the joint. FIG. 18 is a right side centerline cross section elevation view of the dispenser-cutter carrier, DCC 64 which carries the WCA. It shows the cutter assembly with the cutter blade in the home position. FIG. 19 is like FIG. 18, showing the cutter blade in its activated, or tape cutting position. FIG. 22 is a transverse (y-z plane) cross section of the assembly of FIG. 18. Some components of the cutter assembly are shown in FIGS. 23–25. How the cutter interacts with the tape which runs from the tape dispenser foot, and its relation to the position of the SCC, is illustrated in FIG. 26, 27. See also FIG. 7 and the exploded view of FIG. 20.

With reference mainly to FIGS. 18, 19 and 22, the cutter assembly comprises zig-zag shape actuator 140 which serves to move the cutter blade forward, so tape is cut after a tape laying run by the head across the width of sheets being spliced. The actuator 140 has a rear end tang 141, having a slot 180. The tang is supported by passing through opening 112 in the rear lip 108 of body 70. See FIGS. 20 and 25. The front end of actuator 140 runs beneath the slide 100 of the DCC and rests on top of cutter blade 160 which in turn rests on wiper 152. A lower surface projection 170 of the actuator engages a hole 172 in the blade, enabling the actuator to move the blade fore and aft. For clarity of illustration, the blade is shown in much exaggerated thickness. In one example, the wiper and actuator are about 0.12 inch thick steel pieces and the steel blade is about 0.06 inch thick.

A slotted tee bar 154 runs slidably within a slot 159 of the slide. It is pressed downwardly by spring 132. Wiper 152 is rigidly connected to the tee bar by means of two screws 164 running through cylindrical spacers 165. Cutter blade 160, having a cutting tip 162, slidably rests on top of the wiper. The blade 160 has a slot 168 and the actuator has a slot 166, both of which enable the actuator to move the blade relative to the screws and the wiper. See FIG. 20. Springs 163 around the spacers 165 press downwardly on small washers, and thus on the top surface of the actuator 160. That spring action pushes both the actuator and blade into intimate contact with the top surface of the wiper 152. The actuator 140 is shown in its home position in FIG. 18. When the actuator is moved forward from the home position, as illustrated by FIG. 19, it slides the blade over the wiper surface, against the frictional force generated between the blade and the top surface of the wiper by the action of the springs 165.

Figure 20:
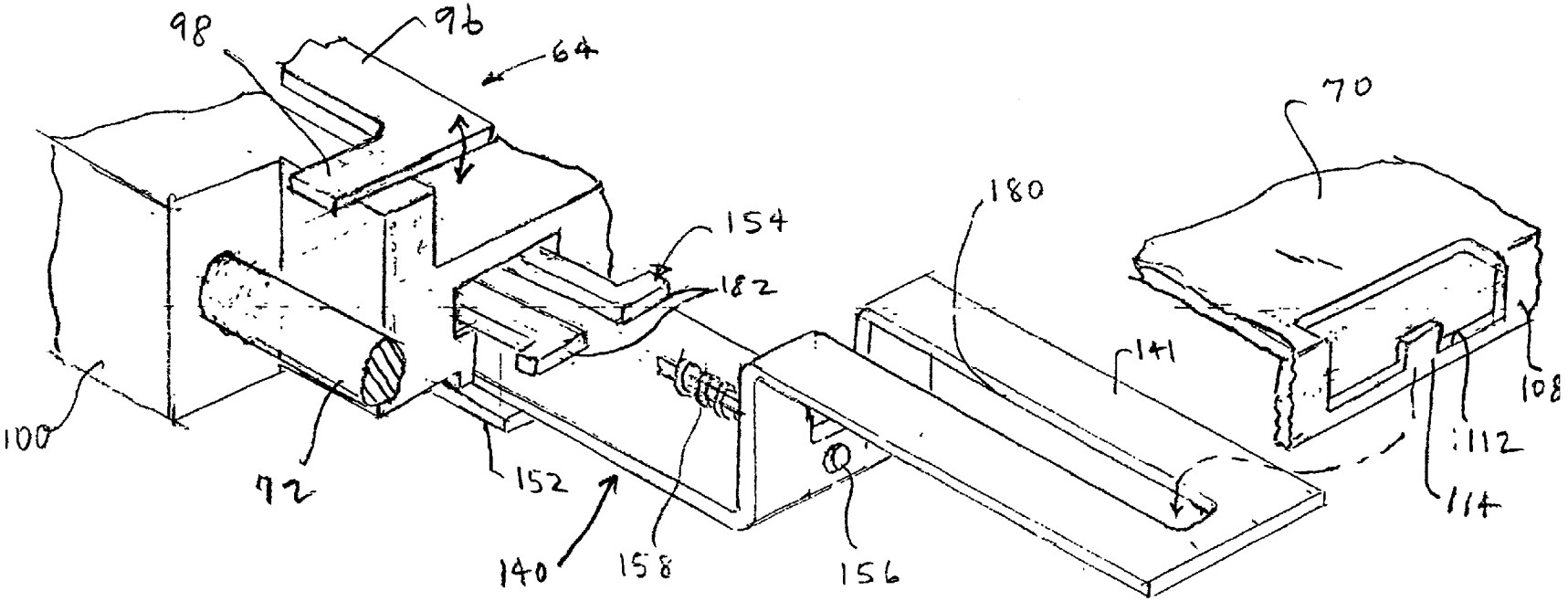
FIG. 20 is a fragmentary isometric view of the rear end of the dispenser cutter assembly, showing a portion of the cutter assembly.

A center guide rod 156 runs horizontally from a hole 157 in the vertical portion of the zig-zag shape actuator 140 to a downward extending tab 176 of the tee bar 154. Spring 158 is wound around the rod 156. The right end of the rod is slidable through the hole 157 in the actuator. With reference to FIGS. 18 and 20, it will thus be appreciated that as the actuator is moved forward within slide 100, it will not only move the blade from its protected stored position, but it will push the tee bar forward due to action of spring 158. Finally, the tabs 182 of the tee bar will engage the rear surface of the slide, and with continued motion, the spring 158 will be compressed. Of course, when the tee bar moves forward, the WCA moves forward. The significance of this will be appreciated by reference to FIG. 8 which shows the WCA in its home position relative to the slide 100 and foot 122.

When there has been forward force on the actuator, the spring 158 will have been compressed. When the operator releases the handle of the body, and thus releases the manual forward force, the force of spring 158 causes the actuator 140 to move rearward relative to slide 100, thus returning the blade to its hidden stored position relative to the wiper. The tee bar 154 remains in its position within the slide 100. When the operator commences another cycle of slit and tape, and applies the initial rearward force to move the body as will be described in more detail, that force causes the elements of the head 99 to move rearward by either of two modes, depending on whether slitting is taking place of if the head is simply being moved to the rear for tape laying only. If there is slitting, the pin of handle 54 engages the arm 78, and that pushes the SCC. The DCC is pushed by action of the spring 138 which circumscribes the guide rod 68. If there is no slitting, movement of the main body moves the rear end of guide bar 68 which is engaged with the main body rear lip 108. The opposing or front end of bar 68 pulls on the slide 80 of SCC, moving SCC.

As mentioned, at a certain point, when the head engages the rear stop, the SCC 66 approaches closely to the DCC 64. Because the home position of the WCA is selected as was just described, when the head is moved rearward, to contact the rear stop, the slitter knife can travel sufficiently far in approaching the front of the DCC, while moving in the rearward direction, to thus ensure that the whole width of a sheet will be slit. As described below, the foot is lifted also, to enable the desired complete slitting.

Wiper 152 is adapted to press on the tape just after it is pressed down with a force imparted by spring 163. How the wiper works, so that the tip in vicinity of the cutting edge of the blade selectively presses on the tape, will be appreciated by reference to FIGS. 18 and 22. The vertical dimension of the slot 159 is greater than the thickness of the tee bar 144, thus enabling linear and rotational movement of the tee bar and the wiper in the x-z plane. See the phantom of the tee bar in FIG. 18. The dimensions of the diverse parts are chosen so that such enabled motion occurs when the wiper is contacted with the sheet. The wiper contacts the sheet when the top 20 of the splicer is closed onto the base 22, to capture sheet between the rubber strips 36 on the top of the base and the thick rubber strips 38 on the underside of the top. The base, strips and rails of the top are shown in phantom in FIG. 22, relative to the slide 100 and WCA. In the absence of such contact, the wiper has a rest position such that its front end is lower than the rear end. Thus, where there is contact, the tip or nose 177 of the wiper, which is the wiper end nearest the foot of the tape dispenser, will contact the tape. The wiper has a rest angle T of about two degrees, as shown in FIG. 18. The angling is accomplished through control of the elevation at which the rear tang 141 of the actuator is supported in the opening 117 of the actuator. See FIG. 20. The rest position angling is sufficient so that some angling persists when the wiper contacts the sheet, during use of the splicer. Thus, it is assured that the front end of the wiper positively presses on the tape.

Figure 19B:
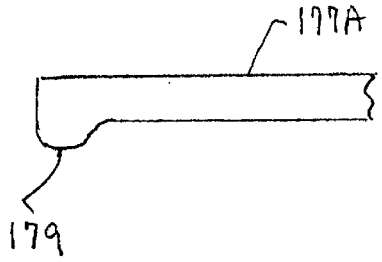
FIG. 19B shows a portion of an alternate wiper.

In an alternate embodiment of the invention, the wiper is not angled and has a nub 179 which contacts the sheet. In another embodiment the wiper is omitted and manual pressing is employed. See FIG. 19B.

Figure 12:
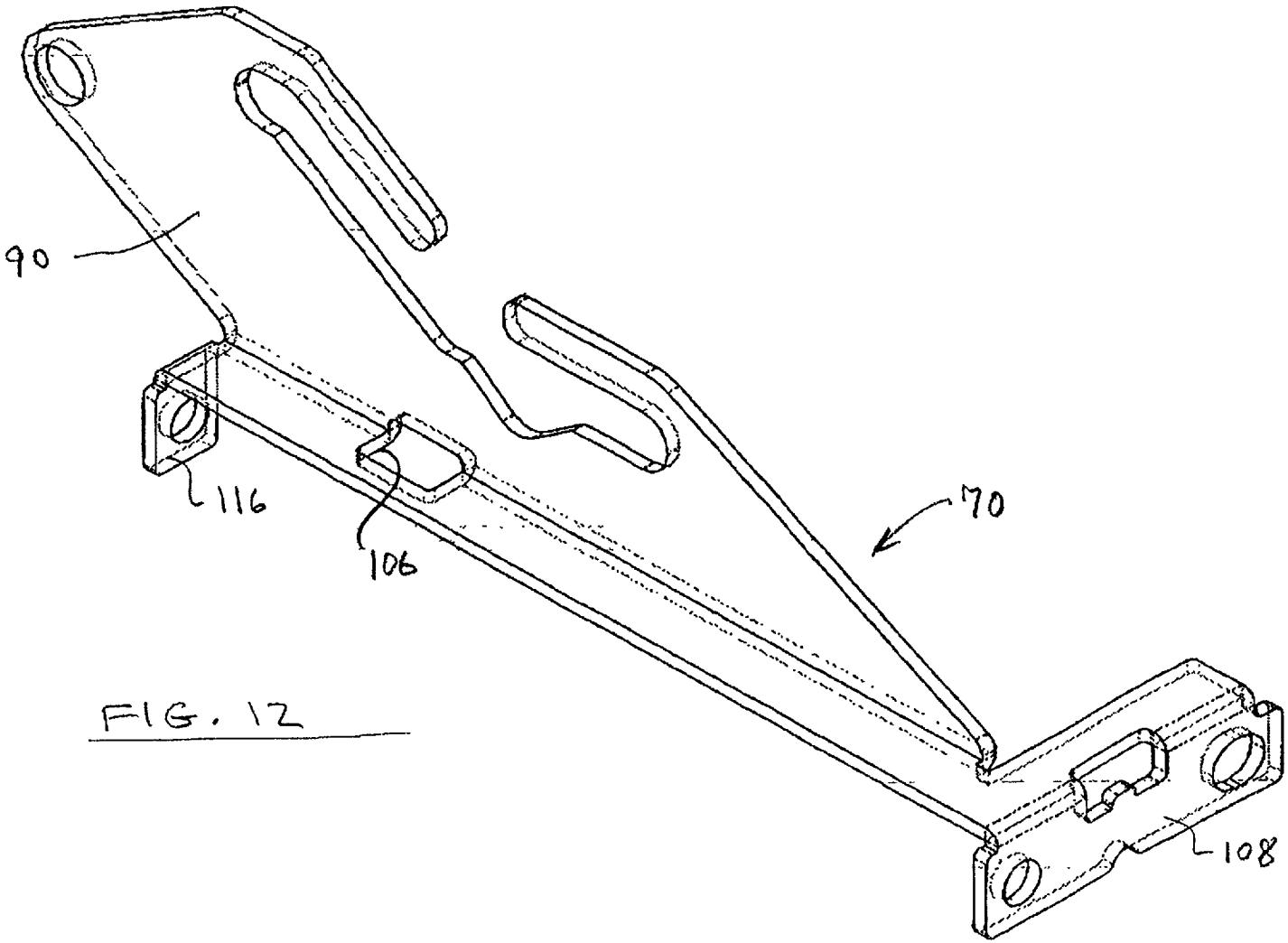
FIG. 12 is an isometric view of the main body.

The main body 70, shown by itself in FIG. 12, is a contoured sheet metal piece which is supported at opposing ends by one of the carriers, SCC and DCC. See FIGS. 7, 8 and 19. The main body 70 has lips 108, 116 at the opposing ends. The lips receive the guide rods 68, 72, engaging them and or the slides of the SCC and DCC to achieve the desired motions, as is described further below. The main body 70 comprises an upward projecting cam plate 90 to which is connected the handle. The cam plate 90, best illustrated in FIG. 8, comprises a contoured female cavity the surface of which comprises the cam. The cam follower 120, affixed to the dispenser plate, runs within the female cam during use. The cam 104 has a vertical opening which enables the cam to escape the plate. That escape enables the dispenser plate to be rotated upwardly as illustrated by the arrow in FIG. 13, for access to the tape path. In other embodiments, different cam and follower configurations and arrangements can be employed to accomplish the motions which are described herein.

In operation, sheet is first captured within the splicer, before taping, by laying it onto the base and manually closing the top. There are two different modes in which the sheet is positioned or aligned accurately within the splicer, to get the desired precision of joining. As a reference point, the ends, or header and footer, of the sheets might simply be butted together carefully by an operator using visual observation. The usual aim is to both get minimal gap or accurate sheet-edge perforated hole spacing (as the case may be) and to get accurate spacing and orientation in the x-y plane, so there is no bend in the spliced sheet and so that the parting line to parting line spacing for fanfold sheet is maintained. Sometimes, a perforated tape is used, and the perforation of the laid-down tape must be consistent with the foregoing aims.

In the first mode, the desired precise butting will be accomplished with perforated sheet, by raising the retractable pins 40 above the surface of the base, and by placing the ends of the two sheets upon the pins. This works well, assuming the termination of the sheet ends relative to the side perforations is normal, that is, the sheet ends butt closely.

Figure 21A:
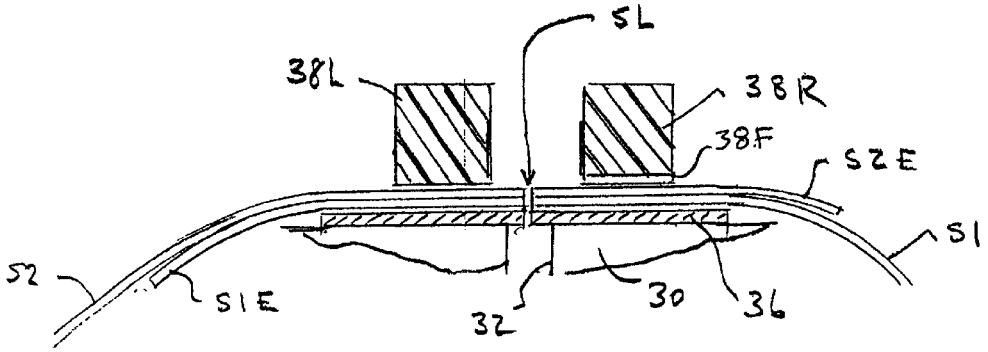
FIG. 21A is a fragmentary end elevation cross section view of the mating of the strips of the base and top when the top has been closed upon overlapped sheets.

In the second mode, the sheets are intentionally overlapped and then slit. The second mode is most appropriate for unperforated edge sheet, but can be employed with perforated sheet in combination with, or without, the use of the retractable pin arrays. Assume for now, the sheet is plain, that is, unperforated. With reference to FIG. 21A, the ends of sheets S1 and S2 are laid on top surface of base 22. FIG. 21A is a fragmentary end view of a splicer like that shown in FIG. 1, with the top 20 rotated down onto the base 22. The x axis spacing between the clamp assemblies 42 has been previously adjusted to fit the sheet width. Thus, the edges of the sheets being joined are pushed against and guided by the edges 52 of the opposing pairs of clamp assemblies 42. Alternately, only one of the pair of edges can be used for edge alignment of the sheets. The clamp arms 49 are rotated so clamp pads 46 press down toward the surface of the base. First, they press on sheet S1 by itself. Then the operator raises and then re-lowers the clamps as she places the second sheet S2 on the base, so it overlays sheet S1. Then, the top of splicer is pivoted down, so the rubber pieces of the top and base press fully on the overlapped sheets. The clamp assemblies 42 may now optionally be released.

Figure 21B:
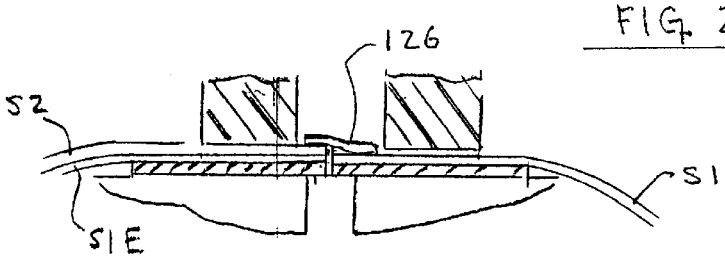
FIG. 21B is like FIG. 21A, showing how a waste piece has been removed.

A slit cut SL, shown in FIG. 21A is then made by moving the head rearward as described in the next section. This produces the waste or trim pieces S1E and S2E which temporarily remain held in place. Given that the right strip 38R of the top of the splicer has a thin anti-friction film 38F on its lower surface, the operator grabs the severed trim end piece S2E and slidingly removes it. The removal of S2E trim piece without dislodging the underlying S1 sheet is possible because, by design, the coefficient of friction between the sheet S1 and the rubber layer 36 is greater than the coefficient between the trim piece S2E and the anti-friction surface of film 38F, and between the trim piece S2E and the upper surface of the underlying sheet S1. The tape 126 is then laid down, as described below. That produces a splice joint on the sheet configuration which existed at the time the waste sheet S2E was removed. See FIG. 21B. When the splicer is opened by raising the top, the trim piece S1E is removable, or falls to the floor.

In other embodiments of the essential invention, the sheets may be aligned by other means known for such purpose. And they may be held in place by other means, with and without the use of rubber strips. For instance, the sheets may held down onto the base by a vacuum pulling on the sheet through perforations in the base.

When the opposing sheet pieces are properly clamped in place by the top of the splicer pressing on the base, the operator manually moves the handle 54 toward the rear to slit the sheets and form a joint. If the sheet is to be slit, the operator moves the pin 88 in handle 54 so as to engage and pivotably lower the slitter knife arm upon rearward motion of the handle. If no slitting is required, the step of moving the pin 88 is omitted; and, the rearward motion is the same as if slitting was being done.

The motions of the various components during a cycle are determined in part by the cam follower 120 interacting with the female cam cavity 104 of the cam plate 90. FIG. 14 shows the locations of the cam follower at various points during the operational cycle. How this is accomplished will be appreciated in the context of the foregoing description. When the handle is manually moved rearward, the cam follower is in position S, shown in the FIG. 14. The operator manually extends the pin 88 of the handle, so it engages the arm of the slitter knife, thus rotating the arm against the bias spring, and causing the outer end, or rearward end of the knife 82 of the slitter to drop downwardly to its rest position within the slot 79 of slide 80. As the handle rearward motion continues, the whole head assembly moves and any sheets clamped in the splicer are slit.

As mentioned above, the slide 100 of SCC 64 is moved by one of two forces, according to whether slitting does or does not take place. When slitter knife approaches the rear edge of the sheet being slit, the slide 100 of DCC 64 hits the rear stop 74. The operator applies continued rearward force on the handle. That causes the body and in particular the rear lip 108 of the main body to continue to move. First, the tang of 98 of the latch 94 moves out to the slot 106 and slides along the underside of the main body. This is due to the tang's inclined angle, previously described. Second, the left guide rod pulls the slide 80 of the SCC 66 rearward. Third, the motion of the tab 114 of rear lip 108 of the body engages the rearmost end 141 of the actuator 140, moving the WCA rearward in coordination with the rearward motion of the slitter knife. The rearward motion of handle, carrier, and thus slide 80 compresses the spring 138 on left guide bar 68, closing the space between the carriers DCC and SCC, and enabling the slitter knife to approach close to the DCC slide face, and to thus cut the entire width of the sheet.

The rear stop 74 had been previously positioned so that, as described in the next step, when the operator pulls the handle forward to lay down the tape, the tape dispenser foot will be properly located for starting the tape at the precise desired location. Preferably, the dimensions of the components are selected so that the slitter knife, at its extreme position, will cut a fraction of an inch beyond the point at which the tape starts for any given stop position. Different dimensions can be chosen to change the distance relation between the tape start zone the slit zone.

As the carriers SCC and DCC move closer due to rearward motion of the handle and body, the cam follower rides up along path RS, shown in FIG. 14. That causes the dispenser plate to rotate upwardly and thus the foot 122 will rise from the vicinity of the sheet surface and within the space between the carriers, sufficient to enable the knife 82 to move toward the SCC within the space. Simultaneously, (a) the rear tip of the slitter knife 82 and the tapered rear end of the SCC approaches very close to, but do not contact the front edges of the DCC; and, (b) the ends of the slides 80, 100 collide, thus stopping the motion of SCC (since the DCC had already been stopped from moving by engagement with the stop 74).

At this point the slitting is complete. A cut SL which defines a butt line has been formed; and, the operator can and should release the force on the handle in controllable fashion. Releasing the force (a) enables the bias spring 92 to rotate the slitter knife arm 78 and thus to raise the knife upwardly to its rest position with in the groove 79; and, (b) enables the left guide bar spring 138 to separate the carriers by moving the SCC in the forward direction. It will thus be appreciated from the foregoing, along with the discussion relating to FIGS. 9 and 10, that the SCC travels a greater distance along the x axis than does the DCC.

When the force on the body is released, and as the SCC moves forward, it causes the body 70 to move forward. That of course means cam plate 70 moves relative to the DCC and its cam follower 120, so the follower moves to position S shown in FIG. 14. When the SCC moves forward, gravity causes the tape dispenser plate 110 to fall back to its rest position between the carriers. When the cam follower 120 moves to position S, the tape dispenser foot is enabled to rest on the sheet surface with gravity force. To the extent there is any tendency for the cam follower 120 to be in position T, because of the play necessarily designed into the head, the operator will appropriately nudge the handle. The head is now at the start location for the next step, which is laying down of the tape.

The operator now move the handle 54 of the body forward, aided by the action of spring 138 on the guide bar 68. The space between the SCC and DCC opens up again. See FIG. 9(D). The motion also causes the cam follower to drop to position T. See FIG. 14. The tape dispenser foot 122 thus drops into the re-opened space between the carriers and re-contacts the sheet surface by weight of gravity. That contact limits downward motion of the dispenser plate, and by design, the cam follower will be at position T within the cam opening, and it does not drop so low as to contact the lower surface of the opening.

As the operator pulls the handle and body forward, the right tang 98 of the latch 96 mounted on the DCC, which had been sliding along against the underside of the main body 70, due to its spring bias, engages the slot 106 of the main body. That engagement limits further relative motion of the DCC and main body, and causing the DCC to start to move forward with the SCC. See FIG. 9(E). Since the tape which was around the bottom of the foot is adhered to sheet by the dropping of the foot onto the sheet surface, the tape is drawn from the spool and onto the surface of the sheet. The operator then moves the head smoothly along the length of the butt-line between the sheets.

When the head reaches the front end of the top, the left tang 102 of latch 96 on the DCC engages the front stop 76, causing the latch to rotate slightly. This (a) causes the latch 96 to rotate counterclockwise, thus disengaging the right latch tang 98 from slot 106 in the main body. See FIGS. 7 and 15; and, (b) stops further forward motion of the DCC. The main body, having been freed of engagement with the DCC, further pulling by the operator causes the main body and cam plate to move forward relative to the DCC. As a result, the cam follower 120 moves to position F, shown in FIG. 14. The force on the cam raises the dispenser plate and thus the foot 122 upwardly off the sheet by an amount sufficient to enable the blade of the cutter assembly to advance and sever the tape, as described next.

Figure 27:
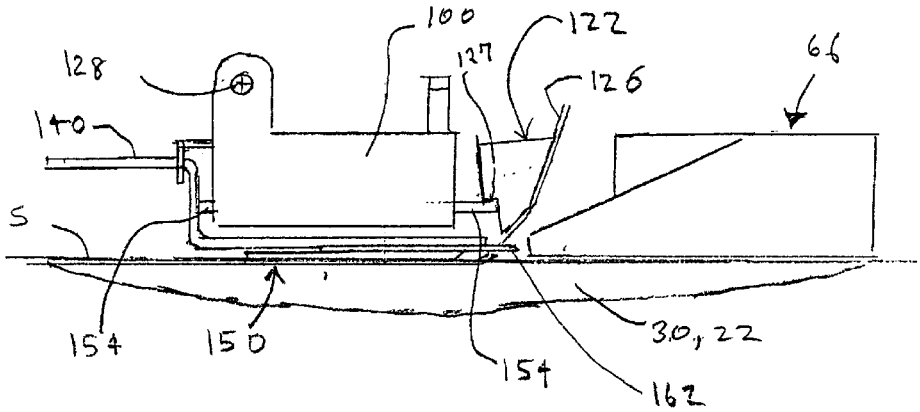
FIG. 27 is a portion of a figure like FIG. 26, showing retraction of the tape dispenser foot and advance of the blade of the cutter assembly at the time the tape is being cut.

FIG. 26 is a left side elevation view of the carriers, SSC 64 and DCC 66, and body 70 as the DCC reaches the front stop. It shows the tape 126 running down and under the foot 122, onto the surface of the sheet S which lies on the base. The cutter blade is in the retracted position, within the cutter assembly 150. As mentioned in the prior section, although there is continued forward motion of the handle and body 70, the DCC stops moving due to engagement of the left tang 102 with the front stop 76, and the dispenser plate and foot have been raised, as illustrated by FIG. 27. Continued forward motion of the main body relative to SCC due to pulling on the handle 54 by the operator causes the rear lip 108 of the body to engage and move forwardly the actuator 140. That advances the tip of cutter blade 162 beyond the tip of wiper 152, as previously described and as illustrated in FIG. 27. Thus, the tape is cut.

The continued forward motion of actuator 140 also pushes on the rear end of tee bar 154, causing the bar to slide within the slot 159 of slide 100 of DCC 40, to an extent such that die front end of the tee bar engages the step 99 at the rear of the foot, as shown in FIG. 27, to prevent the foot from dropping back onto the sheet.

The operator then controllably releases the force on the handle 54. The spring 158 on the center guide bar pushes the actuator rearward, acting against the tab of the tee bar, thus retracting the tip of blade 162 to its protected home position, rearward of the wiper front end. Since the step 127 of the foot is engaged with the tee bar as shown in FIG. 27, the foot is kept from re-contacting the sheet. Thus, tape will not engage the sheet when during the start of the next slitting step, and, prior to the cam "taking control" upon commencement of rearward motion of the body in the next cycle of slit and tape. The tee bar will be retracted from its forward position when the WCA is retracted, when the head hits the rear stop, as previously described. That allows the foot to again drop onto the sheet and lay tape.

Having released force on the handle, the operator raises the top 20, to remove the joined together sheet. As necessary, the operator manually presses down on the cut end of the tape on the now accessible butt line. When the top is raised, the intentional frictional force between the two slides of the two carriers and the rails of the top, keeps the carriers from moving rearward.

The operator then inserts into the splicer the sheets for the next joint to be made. She closed the top and commences next cycle by moving the handle/body rearward.

Those skilled in the art will appreciate that variations in design will be within the scope of the essential apparatus and method invention. Thus, for example, the tape may be differently supported than on a spool on the dispenser plate, the springs and guide rails may be differently arranged, the foot, knife assembly, etc., can in general have other shapes and motions. In another embodiment, where only parts of the preferred embodiment of the invention are used, the tape dispenser especially, and or the slitter, may be removable from the top. So, for example, when tape is to be laid down, the operator inserts the tape dispenser in to the guide means and then moves the tape dispenser.

While it is preferred to have a top comprised of two parallel rails 60, in the generality of the invention a slitter and a tape dispenser are guided, to follow a lengthwise path by any of a variety of known mechanical means for causing objects to move along a predetermined straight path. For example, the parallel rails 60 of the top may be replaced with a single lengthwise oblong rail, providing both a linear path and anti-rotation means. The carriers will hang from the rail to proximity of the sheet.

Further, other means can be employed to achieve the carrier motions relative to one another which have been described, that is the method of the invention. Thus the motions can be achieved by means other than the body which connect the carriers, and the body springs and cam system, etc. For instance, a complicated system of powered servomechanisms can be employed to carry out the essential motions of the carriers, and optionally the slitter knife, the tape foot, the wiper, and the cutter blade.

While the operation of the best mode apparatus has been described in terms of manual powering by an operator, if it was economically justifiable a combination of servomechanisms can be employed, in part or full substitution of an operator.

In use, the splicer may be mounted on any flat surface, such as that of a table, conveyor or other device. Or, it may be mounted on a bracket or post attached to the machine with which the splicer is associated; and, may have an undercarriage and wheels, or be used with a dolly, so it can be moved about in a workplace.

It will be evident that certain of the mechanisms can be used separately from the integrated best mode of the invention. For instance, The combination comprising retractable and longitudinally adjustable pins and the rotatable pin rod actuator can be used in other apparatuses than splicers. Such will also be the case for the combination of frictional (magnetic) clamps and pins. For another example, the invention can be used for just slitting or for just taping, in which case major parts of the elements which carry out the omitted function can be omitted from the apparatus.

Although this invention has been shown and described with respect to a preferred embodiment, it will be understood by those skilled in this art that various changes in form and detail thereof may be made without departing from the spirit and scope of the claimed invention.

We claim:

1. Apparatus for splicing sheets, comprising:

a slitter, for transversely slitting a pair of overlapping sheets held within clamping means by cutting along a path which creates a linear butt line therebetween, which pair of sheets comprises a first sheet and a second sheet;

clamp means, for holding said pair of sheets in overlapping fashion, comprising a base having a surface for supporting and frictionally engaging a sheet; and a top, movably mating with the base, for pressing sheet against the base surface;

the top having a first resilient strip and a second resilient strip, spaced apart on either side of said linear butt line path, for contacting and pressing on sheet lying upon the surface of the base; wherein the frictional resistance between said first strip and a sheet is substantially less than the frictional resistance between said surface of the base and the same sheet;

taping means, for applying tape to the surface of the sheets along the linear butt line; and, guide means, for guiding both the slitter and the taping means along said butt line path.

2. The apparatus of claim 1 wherein the slitter is movable in a first direction to slit the sheets; and, wherein the means for applying tape is movable in a second opposing direction to apply tape to the sheets.

3. The apparatus of claim 1 wherein the frictional resistance of the first strip with a sheet is substantially less than the corresponding frictional resistance of the second strip with the sheet.

4. The apparatus of claim 1 wherein said clamp means top is hinged to the base and pivots downwardly onto the base.

5. The apparatus of claim 1 wherein said first resilient strip has a sheet-contacting surface comprised of acetal plastic and said base surface which receives and supports sheet is comprised of foam rubber.

6. The method of splicing sheets which comprises:

clamping onto a base surface a first pair of sheets to be spliced together along a butt line path wherein said pair comprises overlapped first and second sheets, wherein the frictional resistance imparted by clamping to first sheet sliding motion relative to the base surface is less than the corresponding resistance imparted to second sheet sliding motion;

slitting the sheet pair to form a butt line between the sheets and to thereby form a trim piece for each sheet, wherein the trim piece from the first sheet overlies the newly cut end of the second sheet, and wherein both trim pieces are clamped onto the base surface; and, removing said first sheet trim piece from the vicinity of where the sheets are clamped by sliding said first sheet trim piece away from the base, while continuing to clamp the remainder of the first sheet, the second sheet, and the trim piece of the second sheet onto the base;

moving a tape guiding foot lengthwise along the butt line path, from a first point forward to a second point, while pressing the foot on the sheet, to apply adhesive tape to the sheets along a butt line between the sheets;

stopping lengthwise motion of the foot at the second point;

lifting the foot vertically from the sheet and holding the foot above a predetermined elevation, to thereby cause a fixed length of tape to run through space from the sheet surface to the lifted foot;

cutting the tape along said fixed length of tape at said predetermined elevation, to thereby leave a tape free end extending downwardly from the foot to the vicinity of said predetermined elevation;

removing the spliced together sheets from the base surface;

placing and holding on the base surface a second pair of sheets to be spliced together along a butt line path;

moving said lifted and held foot rearward, back to the first point, to prevent said tape free end from contacting the sheets;

lowering the foot vertically onto the sheet at the first point, so the tape free end contacts and adheres to the sheet at a predetermined location; and, repeating the step of moving the foot forward along the butt line, to adhere tape to the second pair of sheets.

7. The method of claim 6 which further comprises applying tape along the butt line for a lesser distance than the total length of the butt line which is created between the sheets.

8. In apparatus for splicing sheets, wherein a first sheet and second sheet are mated together to form an overlapped sheet pair and the overlapped pair is held within clamping means which presses on the sheet pair at two locations spaced apart along the lengths of the sheets of the overlapped sheet pair, wherein both sheets are then simultaneously cut along a linear butt line path lying between said spaced apart clamping means pressing locations, to thereby form first and second sheet trim pieces and related first and second cut sheet ends, the improvement which comprises: clamping means which enables sliding removal from the clamping means of said first trim piece, wherein the frictional resistance to said sliding removal is less than the frictional resistance to sliding removal from the clamping means of the cut end of the second sheet.

* * * * *